US012433421B2

(12) United States Patent
Grabinger et al.

(10) Patent No.: US 12,433,421 B2
(45) Date of Patent: Oct. 7, 2025

(54) BED MICROCLIMATE CONTROL USING HUMIDITY MEASUREMENTS

(71) Applicant: Sleep Number Corporation, Minneapolis, MN (US)

(72) Inventors: Cory Lee Grabinger, Maple Grove, MN (US); Kody Lee Karschnik, Plymouth, MN (US); Reuben Wesley Meline, Maple Grove, MN (US); Gary N. Garcia Molina, Madison, WI (US)

(73) Assignee: Sleep Number Corporation, Minneapolis, MN (US)

( * ) Notice: Subject to any disclaimer, the term of this patent is extended or adjusted under 35 U.S.C. 154(b) by 305 days.

(21) Appl. No.: 17/964,150

(22) Filed: Oct. 12, 2022

(65) Prior Publication Data

US 2023/0111398 A1 Apr. 13, 2023

Related U.S. Application Data

(60) Provisional application No. 63/255,242, filed on Oct. 13, 2021.

(51) Int. Cl.
*A47C 21/04* (2006.01)
*A47C 31/00* (2006.01)

(52) U.S. Cl.
CPC ..... *A47C 21/044* (2013.01); *A47C 21/048* (2013.01); *A47C 31/008* (2013.01)

(58) Field of Classification Search
CPC .... A47C 21/044; A47C 21/048; A47C 31/008
See application file for complete search history.

(56) References Cited

U.S. PATENT DOCUMENTS 1,005,030 A * 10/1911 Hay ..... A47C 21/048 5/284
5,416,935 A * 5/1995 Nieh ..... A47C 21/044 297/180.13
7,877,827 B2 2/2011 Comiskey et al.
7,996,936 B2 8/2011 Comiskey et al.
8,065,763 B2 11/2011 Brykalski et al.
8,181,290 B2 5/2012 Brykalski et al.
8,191,187 B2 6/2012 Brykalski et al.
8,332,975 B2 12/2012 Brykalski et al.
8,402,579 B2 3/2013 Comiskey et al.
8,418,286 B2 4/2013 Brykalski et al.
(Continued)

FOREIGN PATENT DOCUMENTS

KR 20210052661 A * 5/2021

OTHER PUBLICATIONS

International Search Report and Written Opinion in International Appln. No. PCT/US2022/046358, mailed on Feb. 23, 2023, 17 pages.

(Continued)

*Primary Examiner* — Eric J Kurilla
(74) *Attorney, Agent, or Firm* — Fish & Richardson P.C.

(57) ABSTRACT

Bed tools, systems, and methods are provided to control a microclimate (e.g., temperature, humidity, etc.) at a bed top to provide desired comfort and quality sleep experience. A bed system can include a bed microclimate control subsystem configured to obtain microclimate humidity and to set or adjust operating characteristics (e.g., temperature setpoint) based at least in part on the obtained humidity.

20 Claims, 13 Drawing Sheets

(56) References Cited

U.S. PATENT DOCUMENTS

| | | | | |
|---|---|---|---|---|
| 8,621,687 | B2 | 1/2014 | Brykalski et al. | |
| 8,732,874 | B2 | 5/2014 | Brykalski et al. | |
| 8,782,830 | B2 | 7/2014 | Brykalski et al. | |
| 8,893,329 | B2 | 11/2014 | Petrovski et al. | |
| 9,125,497 | B2 | 9/2015 | Brykalski et al. | |
| 9,131,781 | B2 | 9/2015 | Zaiss et al. | |
| 9,603,459 | B2 | 3/2017 | Brykalski et al. | |
| 9,622,588 | B2 | 4/2017 | Brykalski et al. | |
| 9,814,641 | B2 | 11/2017 | Brykalski et al. | |
| 9,974,394 | B2 | 5/2018 | Brykalski et al. | |
| 10,194,752 | B2 | 2/2019 | Zaiss et al. | |
| 10,226,134 | B2 | 3/2019 | Brykalski et al. | |
| 10,405,667 | B2 | 9/2019 | Comiskey et al. | |
| 10,675,198 | B2 | 6/2020 | Brykalski et al. | |
| 10,772,438 | B2 | 9/2020 | Griffith et al. | |
| 11,020,298 | B2 | 6/2021 | Brykalski et al. | |
| 11,045,371 | B2 | 6/2021 | Brykalski et al. | |
| 11,083,308 | B2 | 8/2021 | Zaiss et al. | |
| 11,297,953 | B2 | 4/2022 | Brykalski et al. | |
| 2010/0011502 | A1* | 1/2010 | Brykalski | A61G 7/05 5/423 |
| 2014/0026320 | A1 | 1/2014 | Comiskey et al. | |
| 2014/0182061 | A1* | 7/2014 | Zaiss | A61G 7/05792 5/423 |
| 2014/0201909 | A1* | 7/2014 | Weyl | A61G 7/05792 5/423 |
| 2015/0238020 | A1 | 8/2015 | Petrovski et al. | |
| 2016/0066701 | A1 | 3/2016 | Diller et al. | |
| 2017/0071359 | A1 | 3/2017 | Steele et al. | |
| 2017/0273470 | A1 | 9/2017 | Brykalski et al. | |
| 2017/0280883 | A1 | 10/2017 | Diller | |
| 2019/0208918 | A1* | 7/2019 | DeFranks | A47C 21/044 |
| 2020/0205580 | A1* | 7/2020 | Sayadi | A47C 31/008 |
| 2020/0337470 | A1 | 10/2020 | Sayadi et al. | |
| 2021/0037987 | A1 | 2/2021 | Griffith et al. | |
| 2021/0038453 | A1 | 2/2021 | Brykalski et al. | |
| 2021/0186224 | A1* | 6/2021 | Chapin | A47C 27/15 |
| 2021/0204706 | A1 | 7/2021 | Karschnik et al. | |
| 2021/0204709 | A1 | 7/2021 | Grabinger et al. | |
| 2021/0204710 | A1 | 7/2021 | Grabinger et al. | |
| 2021/0204711 | A1 | 7/2021 | Karschnik et al. | |
| 2021/0204712 | A1 | 7/2021 | Karschnik et al. | |
| 2021/0204713 | A1 | 7/2021 | Karschnik et al. | |
| 2021/0204714 | A1 | 7/2021 | Karschnik et al. | |
| 2021/0204715 | A1 | 7/2021 | Karschnik et al. | |
| 2021/0204716 | A1 | 7/2021 | Karschnik et al. | |
| 2021/0204719 | A1* | 7/2021 | Grabinger | G05B 19/0426 |
| 2021/0204720 | A1 | 7/2021 | Karschnik et al. | |
| 2021/0322237 | A1 | 10/2021 | Brykalski et al. | |
| 2021/0322238 | A1 | 10/2021 | Brykalski et al. | |
| 2021/0386964 | A1* | 12/2021 | Youngblood | A47C 27/085 |
| 2021/0401185 | A1 | 12/2021 | Zaiss et al. | |
| 2022/0232990 | A1 | 7/2022 | Brykalski et al. | |
| 2022/0261020 | A1 | 8/2022 | Molina et al. | |
| 2022/0273115 | A1 | 9/2022 | Pedersen et al. | |
| 2022/0287473 | A1 | 9/2022 | Karschnik et al. | |
| 2022/0304486 | A1* | 9/2022 | Youngblood | A47C 21/048 |
| 2024/0023721 | A1* | 1/2024 | Tar | A47C 27/056 |

OTHER PUBLICATIONS

U.S. Appl. No. 15/685,912, Petrovski et al., Aug. 24, 2017.
U.S. Appl. No. 15/973,279, Brykalski et al., May 7, 2018.
U.S. Appl. No. 17/890,677, Karschnik et al., Aug. 18, 2022.
U.S. Appl. No. 17/890,697, Grabinger et al., Aug. 18, 2022.
U.S. Appl. No. 17/982,730, Karschnik et al., Nov. 8, 2022.
U.S. Appl. No. 18/091,765, Brykalski et al., Dec. 30, 2022.
International Preliminary Report on Patentability in International Appln. No. PCT/US2022/046358, mailed on Apr. 25, 2024, 10 pages.

* cited by examiner

BED MICROCLIMATE CONTROL USING HUMIDITY MEASUREMENTS

CROSS-REFERENCE TO RELATED APPLICATIONS

This application claims the benefit of U.S. Provisional Application Ser. No. 63/255,242, filed Oct. 13, 2021. The disclosure of the prior application is considered part of (and is incorporated by reference in) the disclosure of this application.

TECHNICAL FIELD

This document relates to bed systems, and more particularly to devices, systems, and methods for controlling a microclimate of a bed based on humidity measurements.

BACKGROUND

In general, a bed is a piece of furniture used as a location to sleep or relax. Many modern beds include a soft mattress on a bed frame. The mattress may include springs, foam material, and/or an air chamber to support the weight of one or more occupants. Various features and systems have been used in conjunction with beds, including heating and cooling systems for heating and cooling a user of a bed.

SUMMARY

This specification describes bed tools, systems, and methods that can be used to control a microclimate (e.g., temperature, humidity, etc.) at a bed top to provide desired comfort and quality sleep experience. A bed system can include a bed microclimate control subsystem configured to obtain microclimate humidity and to set or adjust a temperature setpoint based at least in part on the obtained humidity. In use, heat can accumulate within one or more layers of the bed due to, for example, the body temperature or sweating of a bed occupant. In some implementations, the heat that has accumulated within one or more layers can be removed by controlling a fan to draw the air from the layers or push the air out of the layers. For example, when the air is drawn from the layers of the bed, ambient air can be pulled from a room into the bed and mixed with the warmer, humid air at or around the bed (i.e., the air warmed by the accumulated heat within the layers of the bed). Thus, the resulting microclimate air that is being drawn includes humidity that is associated with the heated air due to, for example, sweating of the bed occupant. The resulting microclimate air can then be removed from the bed system by discharging it back into the room environment. In some implementations, the bed system includes a user detection system for detecting occupancy of a user on the bed. The bed system can measure the microclimate humidity and operate the bed microclimate control system (e.g., fan assembly, thermal module, etc.) to achieve an optimal microclimate condition (humidity, temperature, etc.) when the user detection system determines the occupancy of the user on the bed.

In some implementations, the humidity can be measured from the microclimate air that are discharged from the top layer (e.g., comfort layer) of the mattress, and the measured humidity can be used as a proxy for the bed occupant's comfort level. Thus, the measured humidity can be used by a bed control system to automatically adjust a thermal performance level for controlling the microclimate of the bed. In one example, the thermal performance level includes a temperature setpoint for microclimate control. In another example, the thermal performance level includes an air exchange rate that may be controlled by a fan in the bed system. In some implementations, both the humidity and the temperature of the discharged microclimate air can be used to automatically adjust the temperature setpoint for microclimate control. In other implementations, other parameters and measurements can be additionally used to control the temperature setpoint for controlling the bed microclimate. In yet other implementations, the humidity can be used to control the temperature setpoint for the bed microclimate control, without using the temperature of the discharged air and with or without referring to other parameters or measurements associated with the microclimate of the bed. In some implementations, the humidity can be measured as an absolute value or as a difference between the humidity in the discharged microclimate air and the humidity in the ambient environment. The system can measure both temperature and humidity of the discharged air and sets the temperature setpoint based on the collected readings. In some implementations, the bed system can use an environmental humidity level (e.g., room humidity measured by a sensor that is separate from or included in the bed system) and adjust the thermal performance level (e.g., temperature setpoint) to accommodate for changes in the environment around the bed over time (e.g., between nights).

The bed system can include an air controller configured to cause air to move air through the mattress. For example, the air controller includes a fan assembly that can draw air from the mattress to thereby draw microclimate air from the top of the mattress, or blow air into the mattress and towards the top of the mattress. In some implementations, the air controller can provide temperature and humidity control functionalities. For example, the air controller can include at least one temperature sensor and at least one humidity sensor that are configured to monitor the heat and humidity of air being pulled from the mattress. The monitored temperature and humidity can be a direct reflection of the microclimate and mattress system temperature. The temperature sensor and the humidity sensor can be arranged in various locations that are suitable to measure the temperature and humidity of air that represent microclimate temperature and humidity at the top of the mattress. For example, the temperature sensor and the humidity sensor can be positioned in the air controller. Alternatively or in addition, the temperature sensor and the humidity sensor can be positioned outside the air controller. For example, the temperature sensor and the humidity sensor can be arranged in one or more air ducts that fluidly connect the air controller to one or more layers (e.g., air distribution layers) in the mattress. In other examples, the temperature sensor and the humidity sensor can be disposed in the mattress or at the exterior (e.g., the top surface or side of the mattress). Further, the air controller can include the fan assembly having a variable CFM to control an airflow rate of the air moving out of or into the air controller, and thus control how much heat and humidity are removed from the bed system. In some implementations, the bed system can be operated in a closed loop control. For example, thermal and humidity events can be monitored for a predetermined period of time (e.g., throughout the night) by, for example, turning on the airflow system for a short period of time to collect thermal and humidity data from the microclimate environment. Such collected thermal and humidity data can be fed into the system for adjustment to the control system.

In some implementations, the bed system includes an airflow pad system including an air distribution layer configured to promote air distribution at a top layer (e.g., comfort layer) of the mattress. The air distribution layer can be in fluid communication with the air controller so that the air controller can draw air from, or blow air into, the air distribution layer. For example, when air is being drawn by the air controller, a room ambient air can be pulled into the bed and mixed with a warmer and typically more humid air of the microclimate. This microclimate air has a humidity that is related to the sweating of the bed occupant. As this air is removed from the top of the mattress and drawn into the air controller (and then discharged into the environment), the temperature sensor and the humidity sensor can measure the temperature and humidity of the air. As described herein, the measured temperature and humidity can be used to adjust the operation of the air controller to provide a desired microclimate (e.g., temperature, humidity, and/or other suitable air characteristics) at the top of the mattress for desired comfort and user experience before, during and after sleeping.

In some implementations, the bed system can include a temperature control system that uses, as an input, the measured temperature and/or humidity of the air being discharged from the mattress. The temperature control system can then modulate the fan speed to adjust a microclimate setpoint or setting (e.g., a temperature setting, a humidity setting, or a combination thereof), thereby controlling a microclimate (e.g., temperature, humidity, or characteristics affecting the microclimate). For example, the microclimate setpoint or setting can either be set by the manufacturer or automatically set to provide microclimate settings desirable for general users, or manually set by the user to provide personalized settings for individual users. Such a microclimate setpoint or setting can be adjusted based at least in part of the measured temperature only, the measured humidity only, or the combination of the measured temperature and humidity.

By way of example, the microclimate humidity readings (e.g., the measured humidity of the discharged air from the mattress) can be used to automatically set or adjust to some level the microclimate setpoint or setting (e.g., a temperature setting, a humidity setting, or a combination thereof). For example, if the measured humidity readings represent that a bed occupant sweats more than a threshold, the temperature setpoint can be adjusted to a lower temperature so that the bed occupant sweat less. If the measured humidity readings represent that the bed occupant sweats less than the threshold, the temperature setpoint can be increased to a higher temperature so that the bed occupant can feel more warmth. In some implementations, the bed system can adjust a thermal performance level (e.g., temperature setpoint) in future nights to avoid certain situations that have occurred during a given night.

In some implementations, the humidity values that are used as a primary feedback to the bed system can be absolute humidity. Alternatively or in addition, a difference between the measured humidity and ambient humidity can be used as a humidity value that is used as an input to the bed system.

Particular embodiments described herein include a bed system that includes a mattress and an air controller configured to draw air from, or supply air toward, the mattress. The air controller includes a fan assembly configured to cause air to flow, a humidity sensor configured to detect humidity of air, and a processor configured to: receive a temperature setting, activate the fan assembly based on the temperature setting at a first flowrate, receive the humidity of air flowing through the air controller, determine whether the humidity of air exceeds a first threshold value during a first state of sleep, and, based on determining that the humidity of air exceeds the first threshold value during the first state of sleep, adjust operation of the fan assembly to lower the humidity of air below the first threshold value.

In some implementations, the bed system can optionally include one or more of the following features. The processor may operate to, based on determining that the humidity of air exceeds the first threshold value during the first state of sleep, control the fan assembly at a second flowrate that is greater than the first flowrate. The processor may operate to, based on determining that the humidity of air exceeds the first threshold value during the first state of sleep, adjust the temperature setting, and control the fan assembly based on the adjusted temperature setting. The first threshold value may be a predetermined relative humidity value. The predetermined relative humidity value may be 50%. The processor may be configured to determine whether the humidity of air is below a second threshold value during the first state of sleep, and, based on determining that the humidity of air is below the second threshold value during the first state of sleep, adjust the operation of the fan assembly to increase the humidity of air above the second threshold value. The first state of sleep may be an initial state of sleep from a beginning of the sleep. The first state of sleep may be a 3-hour interval from a beginning of the sleep. The processor may be configured to, based on determining that the humidity of air exceeds the first threshold value during the first state of sleep, control the fan assembly at the second flowrate prior to a second state of sleep (which may be different from the earlier one). The second state of sleep may be subsequent to the first state of sleep. The second state of sleep may be a last 3-hour interval of the sleep. The processor may be configured to, based on determining that the humidity of air exceeds the first threshold value during the first state of sleep, adjust operation of the fan assembly to lower the humidity of air below a second threshold value. The second threshold value may be a second predetermined relative humidity value. The second predetermined relative humidity value may be 30%. The processor may be configured to, based on determining that the humidity of air exceeds the first threshold value during the first state of sleep, adjust operation of the fan assembly to lower the humidity of air below the second threshold value prior to a second state of sleep. The second state of sleep may be subsequent to the first state of sleep. The mattress may include a comfort layer having a top surface and an opposite bottom surface, the top surface configured to support a user, and an air distribution layer disposed at the bottom surface of the comfort layer and configured to supply air toward, or draw air from, a first zone of the comfort layer. The air distribution layer may have a higher air permeability than the comfort layer. The air controller may be fluidly connected to the air distribution layer. The air controller may include a temperature sensor and configured to detect a temperature of air flowing through the air controller. The processor may be configured to, based on the temperature of air and the determination that the humidity of air exceeds the first threshold value during the first state of sleep, adjust the temperature setting, and control the fan assembly based on the adjusted temperature setting. The air controller may include a housing. The fan assembly and the humidity sensor may be positioned within the housing. The air controller may include a housing. The fan assembly, the humidity sensor, and the temperature sensor may be positioned within the housing. The bed system may include an air duct that fluidly connects the air controller with the air distribution layer. The air controller may define a first air vent and a second air vent. The first air vent may be fluidly coupled to an end of the air duct. The humidity sensor may be disposed adjacent the first air vent.

Particular embodiments described herein include a mattress system that includes a comfort layer, an air distribution layer, and an air controller. The comfort layer has a top surface and an opposite bottom surface. The top surface is configured to support a user. The air distribution layer is disposed at the bottom surface of the comfort layer and configured to supply air toward, or draw air from, a first zone of the comfort layer. The air distribution layer has a higher air permeability than the comfort layer. The air controller defines an airflow opening that is fluidly connected to the air distribution layer. The air controller includes a fan assembly configured to cause air to move through the air distribution layer, a temperature sensor, a humidity sensor, and a processor configured to receive a temperature setting, activate the fan assembly based on the temperature setting to thereby move air through the air distribution layer at a first airflow rate, receive a temperature signal from the temperature sensor, the temperature signal being representative of a temperature of air that flows through the air controller, receive a humidity signal from the humidity sensor, the humidity signal being representative of a humidity of air that flows through the air controller, adjust the temperature setting based on the temperature signal and the humidity signal, and activate the fan assembly based on the adjusted temperature setting to thereby move air through the air distribution layer at a second airflow rate.

In some implementations, the bed system can optionally include one or more of the following features. The first airflow rate may be different from the second airflow rate. The processor may be configured to operate the fan assembly to draw air from the air distribution layer at the first airflow rate. The humidity signal may represent humidity of the air that being drawn from the air distribution layer. The processor may be configured to operate the fan assembly to blow air toward the air distribution layer at the first airflow rate for a first period of time. The processor may be configured to operate the fan assembly to draw air from the air distribution layer for a second period of time that is shorter than the first period of time. The humidity signal may represent humidity of the air being drawn from the air distribution layer for the second period of time. The second period of time may range from 5 seconds to 10 minutes. The air controller may be configured to heat or cool air based on the temperature setting. The processor may be configured to determine whether the detected humidity of air is greater than a first threshold value, and modify the temperature setting based on the detected humidity of air being greater than the threshold value. The processor may be configured to determine whether the detected humidity of air is smaller than a second threshold value, and increase the temperature setting based on the detected humidity of air being smaller than the threshold value. The first threshold value may be the same as the second threshold value. The mattress system may include an air duct that fluidly connects the air controller with the air distribution layer. The air controller may define a first air vent and a second air vent. The first air vent may be fluidly coupled to an end of the air duct. The humidity sensor may be disposed adjacent the first air vent. The processor may be configured to calculate a humidity difference between the detected humidity of air and ambient humidity, adjust the temperature setting based on the humidity difference, and activate the fan assembly based on the adjusted temperature setting to thereby move air through the air distribution layer at a third airflow rate. The mattress system may include an input device configured to receive a user input of the temperature setting.

Particular embodiments described herein include a method for controlling a microclimate of a mattress. The method includes receiving a temperature setting; activating, based on the temperature setting, an air controller to cause air to move through an air distribution layer of the mattress, the air distribution layer disposed below a comfort layer; receiving a temperature signal from a temperature sensor, the temperature signal being representative of a temperature of air that flows through the air controller, wherein the temperature sensor is positioned within the air controller; receiving a humidity signal from a humidity sensor, the humidity signal being representative of a humidity of air that flows through the air controller, wherein the humidity sensor is positioned within the air controller; adjusting the temperature setting based on the temperature signal and the humidity signal, and activating, based on the adjusted temperature setting, the air controller to move air through the air distribution layer at a second airflow rate.

In some implementations, the bed system can optionally include one or more of the following features. The first airflow rate may be different from the second airflow rate. Activating the air controller may include activating the air controller to draw air from the air distribution layer at the first airflow rate. The humidity signal may represent humidity of the air that being drawn from the air distribution layer. Activating the air controller may include activating the air controller to blow air toward the air distribution layer at the first airflow rate for a first period of time. The method may include activating the air controller to draw air from the air distribution layer for a second period of time that is shorter than the first period of time. The humidity signal may represent humidity of the air being drawn from the air distribution layer for the second period of time. The second period of time may range from 5 seconds to 10 minutes. The method may include heating or cooling air based on the temperature setting. The method may include determining whether the detected humidity of air is greater than a first threshold value, and decreasing the temperature setting based on the detected humidity of air being greater than the threshold value. The method may include determining whether the detected humidity of air is smaller than a second threshold value, and increasing the temperature setting based on the detected humidity of air being smaller than the threshold value. The first threshold value may be the same as the second threshold value. The air controller may be fluidly connected to the air distribution layer via an air duct. The air controller may define a first air vent and a second air vent. The first air vent may be fluidly coupled to an end of the air duct. The humidity sensor may be disposed adjacent the first air vent. The method may include calculating a humidity difference between the detected humidity of air and ambient humidity; adjusting the temperature setting based on the humidity difference; and activating the fan assembly based on the adjusted temperature setting to thereby move air through the air distribution layer at a third airflow rate. The method may include receiving an input of the temperature setting via an input device.

Particular embodiments described herein include a mattress system that includes a top layer configured to support a user at a top surface, an air controller configured to receive a temperature setting and cause air to move through the top layer based on the temperature setting, and a humidity sensor configured to detect humidity of air that flows from the top surface of the top layer. The air controller is configured to adjust the temperature setting based on the detected humidity of air.

In some implementations, the bed system can optionally include one or more of the following features. The air controller may be configured to control an airflow rate of the air based on the temperature setting. The air controller may be configured to adjust the airflow rate of the air based on the detected humidity or air. The air controller may be configured to draw the air from the top layer based on the temperature setting. The detect humidity of air may be humidity of the air that is drawn from the top layer. The air controller may be configured to blow the air toward the top layer at the airflow rate for a first period of time. The air controller may be configured to draw air from the top layer for a second period of time that is shorter than the first period of time. The detected humidity of air may be humidity of the air that is drawn from the top layer for a second period of time. The second period of time may range from 5 seconds to 10 minutes. The air controller may be configured to heat or cool the air based on the temperature setting. The air controller may be configured to determine whether the detected humidity is greater than a first threshold value; and decrease the temperature setting based on the detected humidity being greater than the threshold value. The air controller may be configured to determine whether the detected humidity is smaller than a second threshold value; and increase the temperature setting based on the detected humidity being smaller than the threshold value. The first threshold value may be the same as the second threshold value. The air controller may include a controller housing, a fan positioned in the controller housing, and a controller positioned in the controller housing. The controller may be configured to receive the temperature setting and control the fan to move air based on the temperature setting. The mattress system may include an air distribution layer positioned under the top layer and configured to distribute air through the top layer, and an air duct that fluidly connects the controller housing with the air distribution layer. The humidity sensor may be positioned within the controller housing. The control housing may include an air inlet and an air outlet. The humidity sensor may be disposed adjacent the air inlet or the air outlet. The fan may be configured to draw air from the top layer. The humidity sensor may be disposed at the air inlet and configured to detect humidity of air entering the control housing at the air inlet. The mattress system may include an input device configured to receive a user input of the temperature setting. The air controller may be configured to calculate a humidity difference between the detected humidity and ambient humidity, and adjust the temperature setting based on the humidity difference.

Particular embodiments described herein include a method for controlling a microclimate of a mattress. The method may include receiving a temperature setting; activating a fan to cause air to move through a top layer of the mattress based on the temperature setting; detecting humidity of air that flows from the top layer of the mattress; adjusting the temperature setting based on the detected humidity; and operating the fan based on the adjusted temperature setting.

In some implementations, the bed system can optionally include one or more of the following features. Activating a fan may include controlling a speed of the fan based on the temperature setting. Activating the fan may include operating the fan to draw air from the top layer of the mattress based on the temperature setting. Activating the fan may include operating the fan to blow air toward the top layer of the mattress based on the temperature setting. Detecting humidity of air may include operating the fan to draw air for a predetermined period of time, and detecting humidity of the air that is drawn for the predetermined period of time. The method may include determining whether the detected humidity is greater than a first threshold value. Adjusting the temperature setting may include decreasing the temperature setting based on the detected humidity being greater than the first threshold value. The method may include determining whether the detected humidity is smaller than a second threshold value. Adjusting the temperature setting may include increasing the temperature setting based on the detected humidity being smaller than the second threshold value. The method may include controlling operation of a fan assembly using the humidity of the air readings.

Particular embodiments described herein include a mattress apparatus that includes a top layer configured to support a user at a top surface, an air controller configured to receive a temperature setting and cause air to move through the top layer based on the temperature setting, a control housing comprising an air inlet and an air outlet, and a humidity sensor disposed adjacent to the air inlet or the air outlet and configured to detect humidity of air that flows from the top surface of the top layer. The air controller is configured to adjust the temperature setting based on the detected humidity of air.

Particular embodiments described herein include a bed system that includes a mattress, and an air controller configured to draw air from, or supply air toward, the mattress. The air controller may include a housing, a fan assembly disposed in the housing and configured to cause air to flow through the housing, a humidity sensor disposed in the housing and configured to detect humidity of air at the housing, and a processor configured to receive a housing humidity signal from the humidity sensor, wherein the housing humidity signal is representative of humidity detected at the housing; based on the housing humidity signal, determine an estimated humidity at a top of the mattress; and based on the estimated humidity at a top of the mattress, adjusting operation of the air controller.

In some implementations, the bed system can optionally include one or more of the following features. The adjusting operation of the air controller may include controlling, based on the estimated humidity at a top of the mattress, the air controller to adjust an airflow rate from the air controller. The processor may be configured to operate the air controller to draw air from the mattress at the first airflow rate. The processor may be configured to operate the air controller to blow air toward the mattress at the first airflow rate for a first period of time. The processor may be configured to operate the air controller to draw air from the mattress for a second period of time that is shorter than the first period of time. The housing humidity signal may represent humidity of the air being drawn from the mattress for the second period of time. The processor may be configured to determine whether the estimated humidity of air is greater than a first threshold value, and decrease a temperature setting of the air controller based on the estimated humidity of air being greater than the threshold value. The processor may be configured to determine whether the estimated humidity of air is smaller than a second threshold value, and increase the temperature setting based on the estimated humidity of air being smaller than the threshold value. The first threshold value may be the same as the second threshold value.

Particular embodiments described herein include a bed system that includes a mattress, and an air controller configured to draw air from, or supply air toward, the mattress.

The air controller includes a fan assembly configured to cause air to flow, a humidity sensor configured to detect humidity, and a processor configured to detect humidity via the humidity sensor, and, in response to detecting humidity exceeding a first threshold, operate the air controller to reduce humidity until detected humidity is below a second threshold that is lower than the first threshold.

Particular embodiments described herein include a bed system that includes a mattress, and an air controller configured to draw air from, or supply air toward, the mattress. The air controller includes a fan assembly configured to cause air to flow, a humidity sensor configured to detect humidity, and a processor configured to detect humidity via the humidity sensor, operate the air controller during a first part of a sleep session to reduce detected humidity below a threshold, and operate the air controller during a second part of a sleep session that is later than the first part of the sleep session to allow detected humidity above the threshold.

The details of one or more implementations are set forth in the accompanying drawings and the description below. Other features and advantages will be apparent from the description and drawings, and from the claims.

DETAILED DESCRIPTION OF ILLUSTRATIVE EMBODIMENTS

This specification describes systems, methods, and techniques for controlling a microclimate (e.g., temperature, humidity, and/or other parameters that may affect the bed microclimate) at a bed top to provide desired comfort and quality sleep experience. A bed system can include a bed microclimate control system configured to sense microclimate humidity and to set or adjust a microclimate setpoint (e.g., temperature setpoint) based at least in part on the sensed humidity. By way of example, heat and humidity can accumulate within one or more layers of a bed due to, for example, a body temperature or sweating of a bed occupant. In some implementations, the bed microclimate climate control system can remove the accumulated heat and humidity within one or more layers of the bed by controlling a fan to draw the air from the layers, or push the air out of the layers. In particular, the operation of the fan (and/or other parts of the bed microclimate control system) needs to be adjusted to remove the accumulated heat and humidity and thus provide the desired microclimate setting for desired comfort.

To determine how much adjustment needs to be made to the control of the fan (and accordingly determine the amount of air that needs to be drawn from or pushed out from the layers of the bed), the bed microclimate control system measures humidity of the air discharged from the layers of the bed, and uses it as an input to the operation of the bed microclimate control system. For example, when the air is drawn from the layers of the bed, ambient air can be pulled from a room into the bed and mixed with the warmer, humid air at or around the bed (i.e., the air warmed by the accumulated heat within the layers of the bed). Thus, the resulting microclimate air that is being drawn includes humidity that is associated with the heated air due to, for example, sweating of the bed occupant. The bed microclimate control system can position sensors for measuring humidity of the air drawn from the layers of the bed and use it as a reliable proxy for the humidity of the microclimate air at the bed top. The operation of the fan can be adjusted based at least part on the measured humidity so that the resulting microclimate air is removed from the bed system and the desired microclimate setting is achieved.

Figure 1:
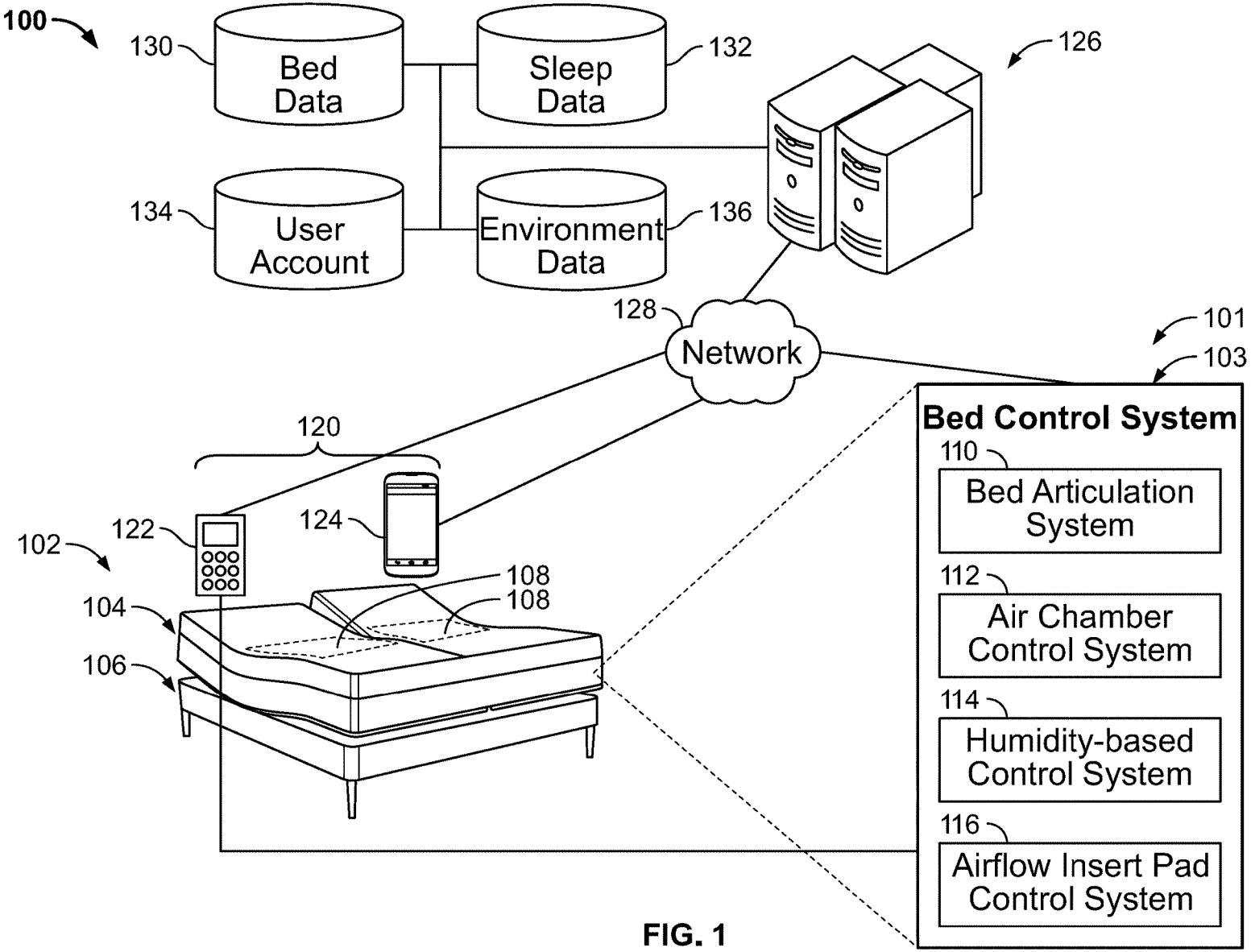
FIG. 1 illustrates an example system for providing a quality sleep experience with an example local bed system.

FIG. 1 illustrates an example system 100 for providing a quality sleep experience with an example bed system 101. The bed system 101 can include a bed 102 and a bed control system 103 used in conjunction with the bed 102 and configured to control one or more user comfort features of the bed 102, including a humidity-based microclimate control described herein.

The bed 102 can include a mattress 104 and a foundation 106. In some embodiments, the mattress 104 can be an air mattress having an inflatable air chamber and a controller for controlling inflation of the inflatable air chamber. In other embodiments, the mattress 104 does not include an air chamber. For example, the mattress 104 may include foam and/or springs instead of or in addition to an inflatable air chamber. The mattress 104 can be sized and shaped as a twin mattress, full mattress, queen mattress, king mattress, California king mattress, split king mattresses, partially split mattress (e.g. a mattress that is split at the head and/or foot ends and joined in the middle), and/or other mattress as suitable for the application. The foundation 106 is positioned under the mattress 104 to support the mattress 104. In some embodiments, the foundation 106 can be an adjustable foundation with one or more articulable sections, such as for raising the head and foot of the foundation 106 and the mattress 104. In other embodiments, the foundation 106 can be a stationary foundation.

In addition or alternatively, the bed 102 can be configured to provide a body cooling/heating function. For example, the bed 102 can include an airflow insert pad 108 that can be included in the mattress 104 and configured to circulate ambient or conditioned air through the mattress under the user at rest. The airflow insert pad 108 can be arranged at various locations in the mattress 104. In the illustrated example, the airflow insert pad 108 is disposed between the head and foot of the mattress 104 (e.g., in the middle of the mattress).

The bed control system 103 operates to control features available for the bed 102. In some implementations, the bed control system 103 includes a bed articulation system 110, an air chamber control system 112, a humidity-based control system 114, and an airflow insert pad control system 116.

The bed articulation system 110 operates to articulate the foundation 106 and/or the mattress 104. For example, the bed articulation system 110 can adjust one or more articulable sections of the foundation 106 to raise the head and foot of the foundation 106 and/or the mattress 104. The bed articulation system 110 can include a controller and an actuator (e.g., a motor) operated by the controller and coupled to the articulable sections of the foundation 106 so that the sections of the foundation 106 are automatically adjusted to desired positions. Alternatively or in addition, the articulable sections of the foundation 106 can be manually adjusted.

The air chamber control system 112 operates to control the air chamber of the mattress 104. The air chamber control system 112 can include a controller and an actuator (e.g., a pump) operated by the controller and fluidly connected to the air chamber. The actuator is controlled to inflate or deflate the air chamber to provide and maintain a desired pressure in the air chamber, thereby providing a desired firmness of the air chamber.

The humidity-based control system 114 operates to detect a humidity of the air being discharged from one or more layers of the mattress and use the detected humidity to automatically adjust a microclimate setpoint (e.g., temperature setpoint) for controlling the microclimate of the mattress. In some implementations, the humidity-based control system 114 can be included in, or implemented as part of, the airflow insert pad control system 116 that controls airflow into or out of the airflow insert pad 108 and maintains the temperature of air at the airflow insert pad 108 or the temperature of air at one or more layers (e.g., a top layer) above or adjacent the airflow insert pad 108 to be a temperature setpoint.

The airflow insert pad control system 116 operates to control the airflow insert pad 108 disposed in the mattress 104. The airflow insert pad control system 116 can include an air controller configured to cause ambient or conditioned air to flow into or out of the airflow insert pad 108 so that a top layer of the mattress above or adjacent the airflow insert pad 108 maintains a desired temperature and/or humidity. As described herein, the airflow insert pad control system 116 can communicate with, or include, the humidity-based control system 114, and adjust a temperature setpoint for controlling the air controller based at least in part on humidity of the air being discharged from one or more layers of the mattress (e.g., the airflow insert pad 108 or the top layer of the mattress).

In some implementations, the bed articulation system 110, the air chamber control system 112, the humidity-based control system 114, and the airflow insert pad control system 116 can be independently configured and operated. In other implementations, some or all of the bed articulation system 110, the air chamber control system 112, the humidity-based control system 114, and the airflow insert pad control system 116 are at least partially combined so that they share at least part of their components such as actuators (e.g., motors, pumps, etc.) and/or controllers (e.g., control circuits, processors, memory, network interfaces, etc.).

The bed control system 103 can be accessed by a user via one or more control devices 120, such as a bed-side controller 122 and a mobile computing device 124. The bed-side controller 122 is wired to, or wirelessly connected to, the bed control system 103 to enable the user to at least partially control the bed control system 103. The bed-side controller 122 includes an input device (e.g., a keypad, buttons, switches, etc.) for receiving a user input of controlling various settings of the bed control system 103, such as articulation positions, temperature settings, humidity settings, air chamber pressure settings, or other suitable bed settings. The bed-side controller 122 can further include an output device (e.g., a display, a speaker, etc.) for outputting the statuses and conditions of the bed control system 103 and other information useful to the user, such as articulation positions, temperature settings, humidity settings, air chamber pressure settings, sleep analysis results, etc. The same or similar functionalities can be implemented with the mobile computing device 124, such as a mobile device running a dedicated software application. For example, the user can use a mobile device as an input device to control various settings of the bed control system 103, such as articulation positions, temperature settings, humidity settings, air chamber pressure settings, etc., and further use the mobile device as an output device to see the statuses and conditions of the bed control system 103 and other useful information, such as articulation positions, temperature settings, humidity settings, air chamber pressure settings, sleep analysis results, etc.

In some implementations, the conditioned air can be supplied to one or more airflow pads 108 arranged under the mattress top, so that the conditioned air is distributed to the mattress top through the airflow pads 108. Alternatively, the bed control subsystem 103 can draw ambient air from the mattress 104, thereby conditioning the temperature at the top of the mattress 104. For example, air can be forced to be drawn from the airflow pads 108 so that air at the mattress top is suctioned into the mattress 104 and permits for the air to be circulated and refreshed at the mattress top. Utilizing supply of conditioned air to provide air at desired temperature to the mattress system, or utilizing air suction to drain heat away from the mattress system, can provide precise microclimate control at the mattress, thereby permitting conformable sleep.

Referring still to FIG. 1, the system 100 can include a server system 126 connected to the local bed system 101 and configured to provide one or more services associated with the bed 102. The server system 126 can be connected to the local bed system 101, such as the bed 102, the bed control system 103, and/or the control devices 120, via a network 128. The server system 126 can be of various forms, such as a local server system with one or more computing devices dedicated to one or more beds, or a cloud server. The network 128 is an electronic communication network that facilitates communication between the local bed system 101 and the server system 126. An electronic communication network is a set of computing devices and links between the computing devices. The computing devices in the network use the links to enable communication among the computing devices in the network. The network 128 can include routers, switches, mobile access points, bridges, hubs, intrusion detection devices, storage devices, standalone server devices, blade server devices, sensors, desktop computers, firewall devices, laptop computers, handheld computers, mobile telephones, and other types of computing devices. In various embodiments, the network 128 includes various types of links. For example, the network 128 includes wired and/or wireless links. Furthermore, in various embodiments, the network 128 is implemented at various scales. For example, the network 128 can be implemented as one or more local area networks (LANs), metropolitan area networks, subnets, wide area networks (such as the Internet), or can be implemented at another scale.

In some implementations, the server system 126 can provide a bed data service that can be used in a data processing system associated with the local bed system 101. The server system 126 can be configured to collect sensor data and sleep data from a particular bed, and match the sensor and sleep data with one or more users that use the bed when the sensor and sleep data were generated. The sensor and sleep data, and the matching data, can be stored as bed data 130 in a database. The bed data 130 can include sensor data that record raw or condensed sensor data recorded by beds with associated data processing systems. For example, a bed's data processing system can have a temperature sensor, humidity sensor, pressure sensor, and light sensor. Readings from these sensors, either in raw form or in a format generated from the raw data (e.g. sleep metrics) of the sensors, can be communicated by the bed's data processing system to the server system 126 for storage in the bed data 130. Additionally, an index or indexes stored by the server system 126 can identify users and/or beds that are associated with the sensor data. In some implementations, the server system 126 can use any of its available data to generate advanced sleep data. The advanced sleep data includes sleep metrics and other data generated from sensor readings. Some of these calculations can be performed in the server system 126 instead of locally on the bed's data processing system, for example, because the calculations are computationally complex or require a large amount of memory space or processor power that is not available on the bed's data processing system. This can help allow a bed system to operate with a relatively simple controller and still be part of a system that performs relatively complex tasks and computations.

In addition or alternatively, the server system 126 can provide a sleep data service that can be used in a data processing system that can be associated with the local bed system 101. In this example, the server system 126 is configured to record data related to users' sleep experience and store the data as sleep data 132. The sleep data 132 can include pressure sensor data related to the configuration and operation of pressure sensors in beds. For example, the pressure sensor data can include an identifier of the types of sensors in a particular bed, their settings and calibration data, etc. The sleep data 132 can include pressure based sleep data which can be calculated based on raw pressure sensor data and represent sleep metrics specifically tied to the pressure sensor data. For example, user presence, movements, weight change, heart rate, and breathing rate can be determined from raw pressure sensor data. Additionally, an index or indexes stored by the server system 126 can identify users that are associated with pressure sensors, raw pressure sensor data, and/or pressure based sleep data. The sleep data 132 can include non-pressure sleep data which can be calculated based on other sources of data and represent sleep metrics obtained from such other sources of data. For example, user entered preferences, light sensor readings, and sound sensor readings can all be used to track sleep data 132. Additionally, an index or indexes stored by the server system 126 can identify users that are associated with other sensors and/or non-pressure sleep data 132.

In addition or alternatively, the server system 126 can provide a user account service that can be used in a data processing system associated with the local bed system 101. For example, the server system 126 can record a list of users and to identify other data related to those users, and store such data as user account data 134. The user account data 134 are related to users of beds with associated data processing systems. For example, the users can include customers, owners, or other users registered with the server system 126 or another service. Each user can have, for example, a unique identifier, user credentials, demographic information, or any other technologically appropriate information. The user account data 134 can include usage history data related to user interactions with one or more applications and/or remote controls of a bed. For example, a monitoring and configuration application can be distributed to run on, for example, the control devices 120. This application can log and report user interactions for storage. Additionally, an index or indexes stored by the server system 126 can identify users that are associated with each log entry.

In addition or alternatively, the server system 126 can provide an environment service that can be used in a data processing system associated with the local bed system 101. For example, the server system 126 can record data related to users' home environment, and store such data as environment data 136. The environment data 136 can be obtained using one or more sensors installed in or around the bed. Such sensors can be of various types that can detect environmental variables, such as light sensors, noise sensors, vibration sensors, thermostats, humidity sensors, etc. The environment data 136 can include historical readings or reports from those sensors. By way of example, a light sensor is used to collect data indicative of the frequency and duration of instances of increased lighting when the user is asleep.

Figure 2A:
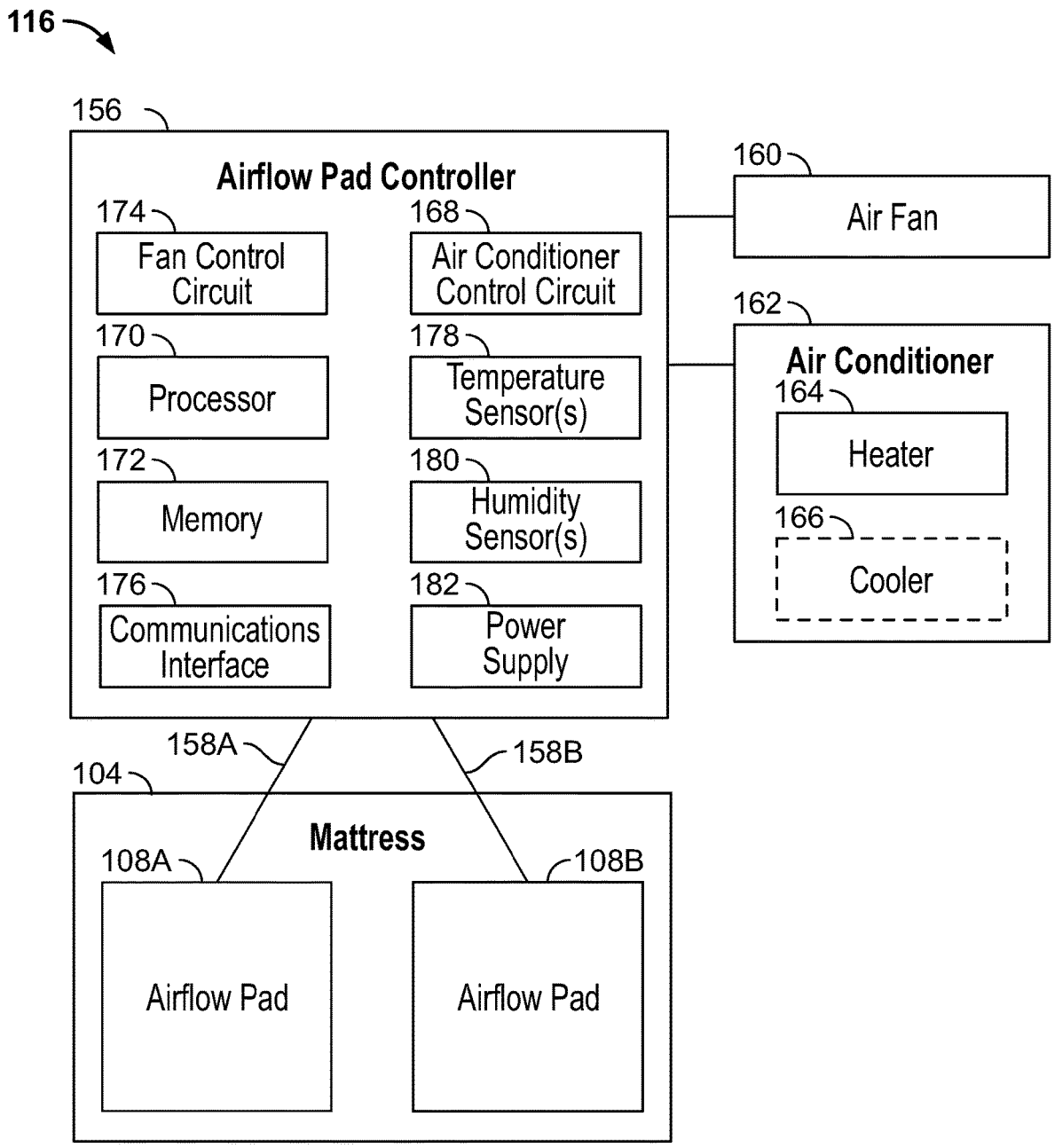
FIG. 2A is a block diagram of an example airflow pad control system that can be associated with a bed system.

FIG. 2A is a block diagram of an example of the airflow insert pad control system 116 that can be associated with the bed system 100. At least part of the system 116 can be also referred to herein as an air controller or the like. The airflow insert pad control system 116 can include an airflow pad controller 156 configured to control airflow through one or more airflow insert pads 108A, 108B. The airflow pads 108A and 108B can be arranged in the mattress 104 and configured to cool or warm at least part of the mattress top. The airflow insert pads 108A and 108B are configured to permit for ambient or conditioned air to flow therethrough so that the air can be distributed through one or more layers above the airflow insert pads 108A, 108B, or that the air can be drawn from the layers above the airflow insert pads 108A, 108B.

The airflow pad controller 156 can be fluidly connected to the airflow pads 108A and 108B via air hoses 158A and 158B. The airflow pad controller 156 is configured to move ambient or conditioned air through the airflow pads 108A and 108B and further through the top layer of the mattress 104 to control a temperature and humidity at a top surface of the top layer. For example, the airflow pad controller 156 can operate to draw air from the airflow pads 108A and 108B through the air hoses 158A and 158B, which causes microclimate air to be drawn from the top layer of the mattress 104 (above the airflow insert pads 108A, 108B) that supports a user, thereby decreasing a temperature at the top surface of the top layer. Alternatively, the airflow pad controller 156 can operate to supply ambient or cooling air to the airflow pads 108A and 108B through the air hoses 158A and 158B, thereby enabling such ambient or cooling air to be distributed through the top layer to push microclimate air out of the top layer of the mattress above the airflow insert pads 108A, 108B, which decreases a temperature at the top surface of the top layer. Alternatively, the airflow pad controller 156 can operate to supply heating air to the airflow pads 108A and 108B through the air hoses 158A and 158B, thereby enabling such heating air to be distributed through the top layer and increasing a temperature at the top surface of the top layer.

In some implementations, the airflow pad controller 156 can include, or be coupled to, an air fan 160 and an air conditioner 162. The air conditioner 162 can include an air heater 164. In addition, the air conditioner 162 can include an air cooler 166. The fan 160 is configured to cause air to flow into or from the airflow pads 108A and 108B. The heater 164 is configured to heat air flowing into or from the airflow pads 108A and 108B. The cooler 166 is configured to cool air flowing into or from the airflow pads 108A and 108B.

In some implementations, the air fan assembly 160 is mounted to the airflow pad controller 156 and configured to cause air to flow through the controller 156. In some implementations, the air fan assembly 160 is configured as a reversible fan assembly configured to cause air to flow in opposite directions. For example, the air fan assembly 160 can be operated to rotate a fan in one direction to cause air to flow from the ambient side to the connection side of the controller 156. Further, the air fan assembly 160 can be operated to rotate the fan in the opposite direction to cause air to flow from the connection side to the ambient side of the controller 156. In some implementations, the air fan assembly 160 can be positioned at the ambient side of the airflow pad controller 156. Other locations of the air fan assembly 160 are possible in other implementations. For example, the air fan assembly 160 can be positioned adjacent to the heater 164, such as between the heater 164 and an air conditioner control circuit 168.

In some implementations, the air fan assembly 160 can be configured as a thermal module for heating, cooling, and air movement. For example, the thermal module can include one or more fans, an electronic circuit board for on-board control, and a heating element. In some implementations, the thermal module can include one or more reversible electric fans, one or more unidirectional axial fans, one or more radial fans, or any combination thereof, to move air into and out of the mattress. The heating element can be disposed in or near air stream to supply warmed air to the mattress 104. The heating element may be sized smaller than the total air passage area to allow increased airflow with the system in the air suction mode, but still supply adequate airflow and temperature increase in the heating mode. The cooling element can be placed in or near air stream to supply cooed air to the mattress 104.

In some implementations, the airflow pad controller 156 can include the heater 164 mounted to it and configured to heat air that passes through. In some implementations, the heater 164 includes a plurality of fins that allow air to flow in between the fins to be heated by the heater 164. As described herein, the heater 164 can be mounted in the airflow pad controller 156 in a location that is at least partially spaced from an inner wall of the airflow pad controller 156 so as to define a bypass flow path that allows air to flow around the heater 164 while air simultaneously flows through the heater 164. Such a bypass flow path can allow effective airflow through the airflow pad controller 156 when air is drawn from the mattress 104 and flows from the connection-side opening to the ambient-side opening, or when air is supplied and flows from the ambient-side opening toward the connection-side opening with or without activating the heater 164.

The airflow pad controller 156 can include a processor 170, a memory 172, a fan control circuit 174, the air conditioner control circuit 168, a communications interface 176, one or more temperature sensors 178, one or more humidity sensors 180, and a power supply 182. The fan control circuit 174 is configured to permit communication between the processor 170 and the fan 160 to control the fan 160. The air conditioner control circuit 168 is configured to permit communication between the processor 170 and the air conditioner 162 to control the air conditioner 162. The communications interface 176 is configured to permit for the airflow pad controller 156 to communicate with other components in the bed system 100, such as at least one of the systems 110, 112, 114, 116, the control devices 120, the user computing device 124, and the server system 126 of FIG. 1.

The temperature sensors 178 are configured and arranged to detect the temperature of air flowing into and/or drawing from the airflow pads 108A and 108B, the temperature of the air conditioner 162 (e.g., the heater 164 or the cooler 166), the temperature of ambient air, and/or other temperatures at different locations in the bed system 100. Such temperature measurements can be used to adjust the operations of the airflow pads 108A and 108B and/or other components in the bed system 1100. For example, the airflow insert pad control system 116 can receive a temperature setpoint and control the air fan assembly 160 and/or the air chamber control system 112 to maintain a temperature of air at or around the temperature setpoint within a predetermined range. The temperature setpoint can be hardcoded or selected automatically by the system or manually by a user using the bed-side controller 122 or user computing device 124. The temperature sensors 178 can be used to measure the temperature of air and use the measured temperature to confirm the measured temperature stays at the temperature setpoint or within the predetermined range of temperature, or otherwise adjust the operation of the air fan 160 and/or the air conditioner 162 to achieve it. In some implementations, the temperature sensors 178 can be arranged in a housing of the airflow pad controller 156 so that the temperature of the air being drawn from the airflow insert pads 108A, 108B into the housing can be measured as a proxy of the temperature of microclimate air at the mattress top. In other implementations, the temperature sensors 178 can be positioned at other locations to measure the temperature of air that flows from, into, or through the airflow insert pads 108A, 108B.

The temperature sensors 178 can be arranged in various locations. In some implementations, one or more temperature sensors 178 can be disposed in a housing of the airflow pad controller 156, which may also houses the air fan assembly 160 and/or the air conditioner 162 (e.g., the heater 164 and/or the cooler 166). For example, at least one of the temperature sensors 178 can be arranged adjacent the air fan assembly 160 and/or the air conditioner 162. In addition or alternatively, one or more temperature sensors 178 can be disposed outside of the mattress 104, such as below the bottom of the mattress 104. In addition or alternatively, one or more temperature sensors 178 can be mounted to a desired location of the mattress 104 (e.g., on the bottom of the mattress). In addition or alternatively, one or more temperature sensors 178 can be arranged in an airflow path between the air fan assembly 160 and the airflow insert pads 180A, 108B.

In some implementations, the airflow pad controller 156 can include the thermal module with one or more humidity sensors 180 (e.g., hygrometer) within the housing. For example, the sensors can be arranged around the heating element. The humidity sensors can be used to automatically set or adjust the temperature setpoint in the bed system.

In some implementations, a humidity sensor 180 can measure the humidity of the microclimate air. The humidity sensor can be disposed in the printed circuit board (PCB) of the engine. In some examples, the humidity sensor is disposed near or adjacent to the discharge airflow pads 108 arranged within the bed system.

In some implementations, a plurality of humidity sensors 108 can be configured and arranged such that a large or substantial amount of air can be sensed from the areas of the mattress that the most amount of heat is built up. For example, the middle section of the mattress (e.g., an area between the head and foot sections) may build up most of heat when sleepers rest on the mattress. Therefore, the plurality of humidity sensors can be arranged in the middle section of the mattress.

In some implementation, the humidity sensor 108 can be configured in different sizes, shapes, and types. For example, the humidity sensor can be capacitive-based sensor that can measure moisture levels using a humidity-dependent condenser. The capacitive-based sensor includes wide ranges and condensation tolerance. In another example, the humidity sensor can be resistive-based sensor that can measure the electrical change in the system's engine. In another example, the humidity sensor can be thermal conductivity-based sensor that can measure humidity by calibrating the difference between the thermal conductivity of dry air and that of moist air.

The humidity sensors 180 are configured and arranged to detect the humidity value of air drawing from the airflow insert pads 108A and 108B. Such humidity measurements can be used to adjust the operations of the airflow insert pads 108A and 108B and/or other components in the bed system 100. For example, the processor 170 can use the humidity measurements (along with or without the temperature measurements) to adjust various operations of the airflow pad controller 156, such as conditioning air, supplying or drawing air to/from the airflow pads 108A and 108B, etc., and/or operations of other components in the bed system 100. In particular, a humidity value or change in humidity of the air that is drawn from the airflow insert pad 108 can represent a humidity condition of microclimate air at or around the top layer of the mattress that supports a user. For example, the user who is sweating on the mattress top during sleep can increase the humidity at the mattress top. The air pad controller 156 can be operated to draw air from the airflow insert pad 108 (and thus from the top layer above the airflow insert pad 108), and the humidity of the drawn air can be measured at a suitable location. The measured air humidity can be used as proxy for the humidity of microclimate air at or around the mattress top and used to adjust the temperature setpoint. Such an adjusted temperature setpoint will adjust operation of the air fan 160 and/or the air conditioner 162 such that the temperature of microclimate air at or around the top layer is adjusted to provide optimal comfort and quality sleep for the user. By way of example, if the humidity of air is measured to have increase from a threshold value or a humidity value at a previous point of time, the temperature setpoint can be lowered so that the air fan 160 and/or the air conditioner 162 can be operated to lower the temperature of microclimate air at the top layer, thereby reducing the humidity of the air.

The humidity sensors 180 can be arranged in various locations. In some implementations, one or more humidity sensors 180 can be disposed in the housing of the airflow pad controller 156, which may also houses the air fan 160 and/or the air conditioner 162 (e.g., the heater 164 and/or the cooler 166). For example, at least one of the humidity sensors 180 can be arranged adjacent the fan 160 and/or the air conditioner 162. In addition or alternatively, one or more humidity sensors 180 can be disposed outside of the mattress 104, such as below the bottom of the mattress 104. In addition or alternatively, one or more humidity sensors 180 can be mounted to a desired location of the mattress 104 (e.g., on the bottom of the mattress). In addition or alternatively, one or more humidity sensors 180 can be arranged in an airflow path between the fan 160 and the airflow pads 108A, 108B.

In some implementations, the system 116 can further include a user detection system configured to detect presence of a user at the bed. Therefore, the techniques of measuring microclimate humidity and/or other conditions and adjusting operation of microclimate control system (e.g., fan assembly, thermal module, etc.) as described herein can be performed based on the user detection system detecting the presence of the user at the bed. The user detection system can employ various techniques, such as using load cells located at the bed (e.g., bed or foundation legs), temperature sensors or sensor strips positioned at or adjacent the top of the mattress, pressure sensors for measuring pressure changes in inflatable air bladders in a bed that are configured to adjust firmness of the mattress, pressure sensors positioned at suitable locations of the bed and configured to detect pressure/weight changes on the bed, or other suitable mechanical, electrical, electromechanical devices for the purposes.

Figure 2B:
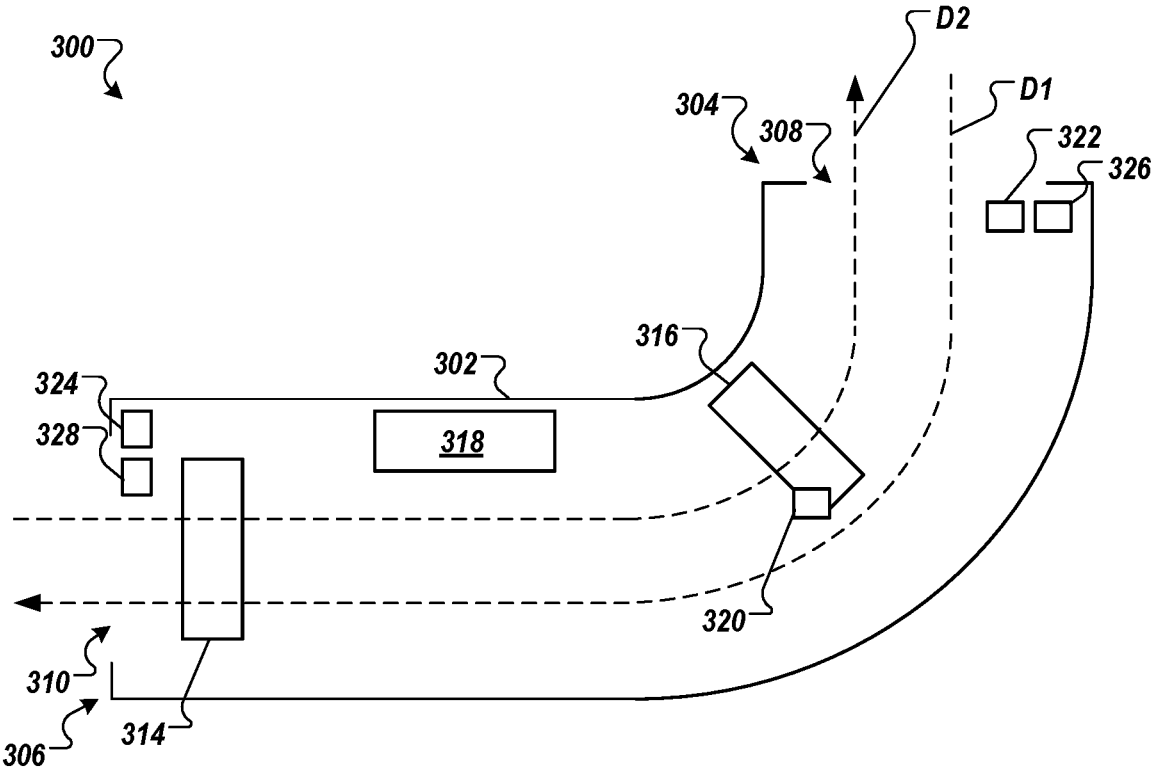
FIG. 2B is a schematic diagram of an example microclimate controller.

FIG. 2B is a schematic diagram of an example microclimate controller 300, which can be used for the bed system 100. The microclimate controller 300 (also referred to herein as an air controller, a thermal module, or the like) can be used to implement the airflow pad insert control system 116 described herein. The air controller 300 is configured to move air into or from an airflow layer (e.g., the airflow pads 108) in the mattress 104. For example, the air controller 300 can be configured to draw air from the airflow layer of the mattress (e.g., in a draw direction D1), and/or supply ambient or conditioned air to the airflow layer (e.g., in a blow direction D2). In addition, the air controller 300 can condition air before supplying it to the airflow layer. For example, the air controller 300 can operate to heat air and cause the heated air to flow into the airflow layer.

The air controller 300 includes a housing 302 having a connection side (e.g., a mattress side) 304 and an ambient side 306. The connection side 304 of the housing 302 is configured to attach to a desired location, such as an underside of a foundation that supports the mattress. The housing 302 includes a connection-side opening (e.g., a mattress-side opening) 308 at the connection side 304, and an ambient-side opening 310 at the ambient side 306. In some embodiments, the housing 302 can be attached to the foundation at the connection side 304 so that the connection-side opening 308 is in fluid communication with a hole of the foundation, and thus in fluid communication with an interior of the mattress when the mattress is supported on the foundation and an air duct from the mattress is fluidly connected to the hole of the foundation. The ambient side 306 of the housing 302 can be exposed to the atmosphere, and air can be drawn from, or discharged into, the surroundings through the ambient-side opening 310.

Referring to FIGS. 2A-B, the air controller 300 can include a fan assembly 314 mounted in the housing 302 and configured to cause air to flow through the housing 302. In some implementations, the fan assembly 314 is configured as a reversible fan assembly configured to cause air to flow in opposite directions. For example, the fan assembly 314 can be operated to rotate a fan in one direction (e.g., the blow direction D2) to cause air to flow from the ambient side 306 to the connection side 304 of the housing 302. Further, the fan assembly 314 can be operated to rotate the fan in the opposite direction (e.g., the draw direction D1) to cause air to flow from the connection side 304 to the ambient side 306 of the housing 302. In some implementations, the fan assembly 314 is positioned at the ambient side 306 of the housing 302. Other locations of the fan assembly 314 are possible in other implementations. For example, the fan assembly 314 can be positioned adjacent a heating element 316, such as between the heating element 316 and a PCB board (e.g., a control unit 318).

In some implementations, the air controller 300 can include a heating element 316 mounted in the housing 302 and configured to heat air that passes through the heating element 316. In some implementations, the heating element 316 includes a plurality of fins that allow air flow in between the fins to be heated by the heating element. As described herein, the heating element 316 can be mounted in the housing 302 in a location that is at least partially spaced from an inner wall of the housing 302 so as to define a bypass flow path that allows air to flow around the heating element 316 while air simultaneously flows through the heating element 316. Such a bypass flow path can allow effective air flow through the housing when air is drawn from the mattress and flows from the connection-side opening 308 to the ambient-side opening 310, or when air is supplied and flows from the ambient-side opening 310 toward the connection-side opening 308 with or without activating the heating element 316.

The air controller 300 can include a control unit 318 mounted in the housing 302 and configured to control the air controller 300 in one or more operational modes. For example, the control unit 318 can operate the air controller 300 in a first mode (e.g., ambient-air-drawing mode) in which the control unit 318 controls the fan assembly 314 to cause air to flow from the connection side 304 to the ambient side 306 so that air is drawn from the airflow layer of the mattress. Alternatively or in addition, the control unit 318 can operate the air controller 300 in a second mode (e.g., heating-air-supplying mode) in which the control unit 318 activates the heating element 316 and controls the fan assembly 314 to cause air to flow from the ambient side 306 to the connection side 304 so that the air passes through the heating element 316 and the heating air is supplied to the airflow layer of the mattress. Alternatively or in addition, the control unit 318 can operate the air controller 300 in a third mode (e.g., ambient-air-supplying mode) in which the control unit 318 controls the fan assembly 314 to cause air to flow from the ambient side 306 to the connection side 304 (without activating the heating element 316) so that ambient air is supplied to the airflow layer of the mattress.

In alternative embodiments, the air controller 300 can include a cooling unit with or without the heating element 316, so that the air controller 300 can be operated in additional operational modes. For example, the control unit 318 can operate the air controller 300 in a fourth mode (e.g., cooling-air-supplying mode) in which the control unit 318 activates the cooling element and controls the fan assembly 314 to cause air to flow from the ambient side 306 to the connection side 304 so that the air passes through the cooling element and the cooling air is supplied to the airflow layer of the mattress.

The air controller 300 can be configured with a printed circuit board. The printed circuit board can be positioned in the housing 302 between the ambient-side opening 310 and the heating element 316. The fan assembly 314 can be positioned in the housing 302 between the ambient-side opening 310 and the heating element 316. The air controller 300 can be electrically connected to the fan assembly 314 and the heating element 316 to control operation of the fan assembly 314 and the heating element 316.

The air controller 300 can include one or more temperature sensors configured to detect temperatures at different locations. For example, the air controller 300 can include a heating element temperature sensor 320 configured to detect a temperature of the heating element 316 and generate a sensor signal representative of the heating element temperature.

The air controller 300 can include one or more other temperature sensors configured to detect air temperatures at various locations in or adjacent the housing 302. For example, the air controller 300 includes a connection-side temperature sensor 322 and an ambient-side temperature sensor 324. The connection-side temperature sensor 322 can detect a temperature of air at the connection side 304 of the housing 302, and the ambient-side temperature sensor 324 can detect a temperature of air at the ambient side 306 of the housing 302. As described herein, when the air controller 300 operates to draw air from the mattress (i.e., in the draw direction D1), the connection-side temperature sensor 322 can detect a temperature of air that is drawn from the mattress and thus represents (or is correlated with) a microclimate temperature at the mattress, such as a body temperature of a user lying on the mattress or a temperature of air around or adjacent the user's body on the mattress. Further, when the air controller 300 operates to supply air toward the mattress (i.e., in the blow direction D2), the ambient-side temperature sensor 324 can detect a temperature of air that is drawn from the surroundings and thus represents (or is correlated with) an ambient air temperature.

In addition, the air controller 300 can include one or more humidity sensors configured to detect a humidity value and generate a sensor signal representative of the humidity value. For example, the air controller 300 includes a connection-side humidity sensor 326 and an ambient-side humidity sensor 328. The connection-side humidity sensor 326 can detect humidity of air at the connection side 304 of the housing 302, and the ambient-side humidity sensor 328 can detect humidity of air at the ambient side 306 of the housing 302. As described herein, when the air controller 300 operates to draw air from the mattress (i.e., in the draw direction D1), the connection-side humidity sensor 326 can detect humidity of air that is drawn from the mattress and thus represents (or is correlated with) a microclimate humidity value at the mattress, such as humidity at or adjacent the user's body lying on the mattress. Further, when the air controller 300 operates to supply air toward the mattress (i.e., in the blow direction D2), the ambient-side humidity sensor 328 can detect humidity of air that is drawn from the surroundings and thus represents (or is correlated with) ambient humidity.

Although the temperature sensors 322, 324 are illustrated as separate from the humidity sensors 326, 328, it is understood that the connection-side temperature sensor 322 and the connection-side humidity sensor 326 can be replaced by a single sensor system that can perform both measurements. Similarly, the ambient-side temperature sensor 324 and the ambient-side humidity sensor 328 can be replaced by a single sensor system that can perform both measurements.

The control unit 318 can receive sensor signals from the temperature sensors 320, 322, 324 and the humidity sensors 326, 328, and control the fan assembly 314 and/or the heating element 316 based in part on the sensor signals to achieve predetermined temperature and/or humidity settings.

Figure 3A:
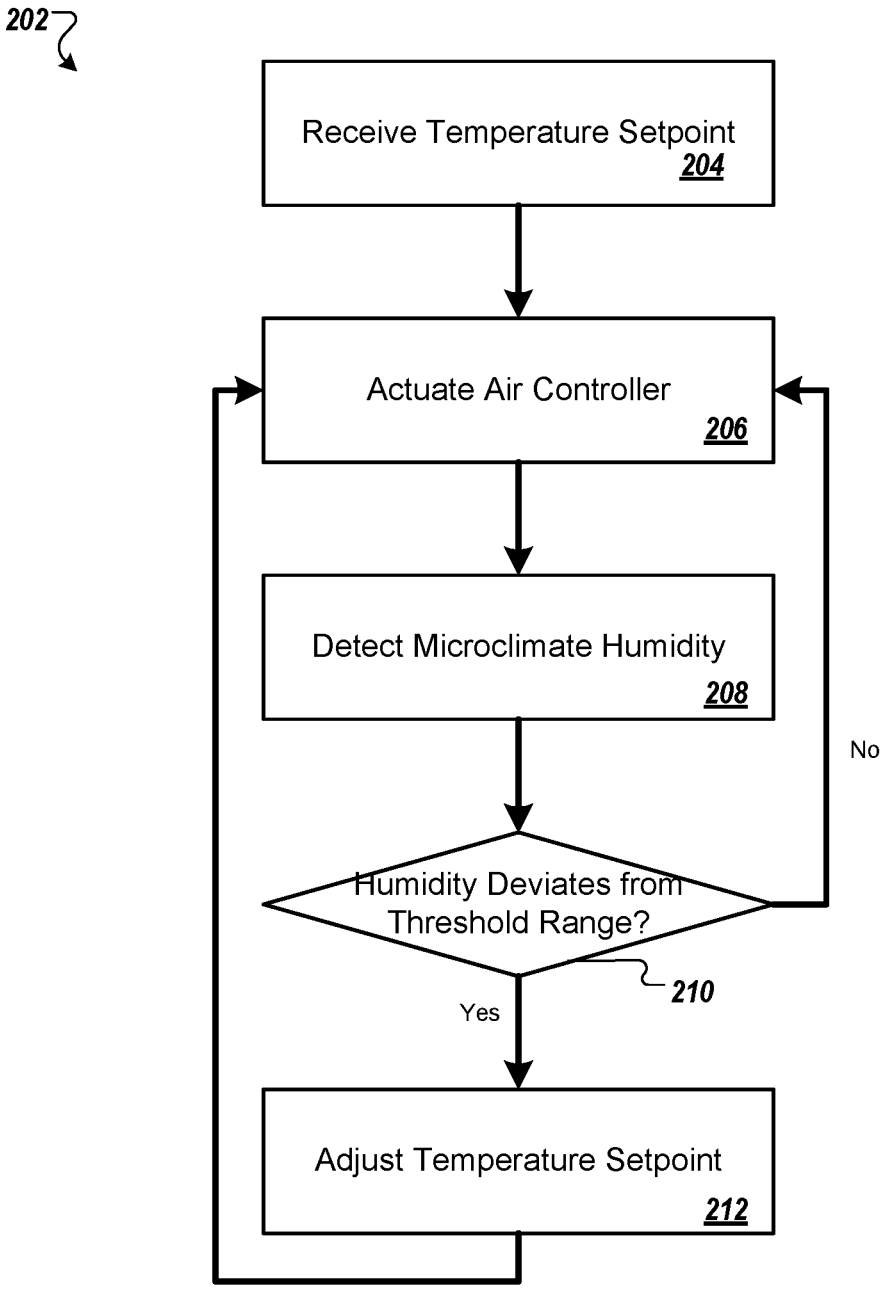
FIG. 3A is a flowchart of an example process for performing a bed microclimate control based on humidity measurements.

FIG. 3A is a flowchart of an example process 202 for controlling microclimate of a bed based on humidity of air. In some implementations, the process 202 can be implemented using the bed system 100 and/or the airflow pad insert control system 116 (also referred to herein as the air controller or the like). The airflow pad insert control system 116 can draw ambient air from, or supply ambient or conditioned air to, the airflow pads 108A, 108B (also referred to as an air layer, air distribution layer, or the like) arranged in the mattress 104 (e.g., below the top of the mattress) to control the temperature at the top surface of the mattress.

In some implementations, the process 202 includes receiving a temperature setpoint (Step 204). In addition or alternatively, the process 202 can include receiving other types of microclimate setpoint, such as a humidity setpoint or other parameters that may affect the microclimate of the bed. For example, such microclimate values or setpoints (or setting, setup, etc.) can be set by a user via, e.g., the bed side controller 122 or the user computing device 124. In some implementations, such values can be automatically determined to satisfy the user profile or preference. Examples of such values include temperature values, humidity, and other suitable values that can be manually or automatically determined.

The process 202 can include actuating the air controller (e.g., the airflow pad insert control system 116) to blow air into the bed, or draw air from the bed (Step 206). The airflow pad insert control system 116 can drive and/or condition the air based on the temperature setpoint, and/or other setpoints or values received at Step 204. For example, the airflow pad insert control system 116 includes the heater 164 that can be activated to heat air as the fan 160 drives the air to pass through or around the heater 164. In other implementations, the airflow pad insert control system 116 can cool air at a temperature that is manually set or automatically determined for improved or optimal microclimate control of the mattress 104. For example, the airflow pad insert control system 116 can include the cooler 166 that can be activated to cool air as the fan drives the air to pass through or around the cooler 166.

In some implementations, the airflow pad insert control system 116 can drive air so that the air is supplied to the airflow insert pads 108A and 108B of the mattress 104. In some embodiments where the air is conditioned, the airflow pad insert control system 116 operates to supply the conditioned air to the airflow insert pads 108A and 108B. In other embodiments, the airflow pad insert control system 116 can operate to supply ambient air to the airflow insert pads 108A and 108B. For example, the airflow pad insert control system 116 activates the fan 160 at a desired speed to drive the ambient or conditioned air to the airflow insert pads 108A and 108B. In alternative embodiments, the airflow pad control system 116 can draw air from the airflow insert pads 108A and 108B of the mattress 104 to thereby control a microclimate at the bed (e.g., decrease a temperature at the mattress top).

The process 202 can include detecting microclimate humidity (Step 208). In some implementations, one or more humidity sensors are used to measure humidity of the air at one or more locations. The process 202 can include determining whether the measured humidity deviates from a threshold value or range (Step 210). In some implementations, the airflow pad insert control system 116 evaluates if the humidity value deviates from a specified threshold range (Step 210). The process 202 can further include, if the value deviates, adjusting the temperature setpoint and/or other setpoints for operating the airflow pad insert control system 116 to thereby optimally control the microclimate of the mattress 104 (Step 212). If the value does not deviate, the process 202 returns to Step 206 in which the airflow pad insert control system 116 can continue to operate based on the earlier temperature setpoint and/or other setpoints received at Step 204.

Figure 3B:
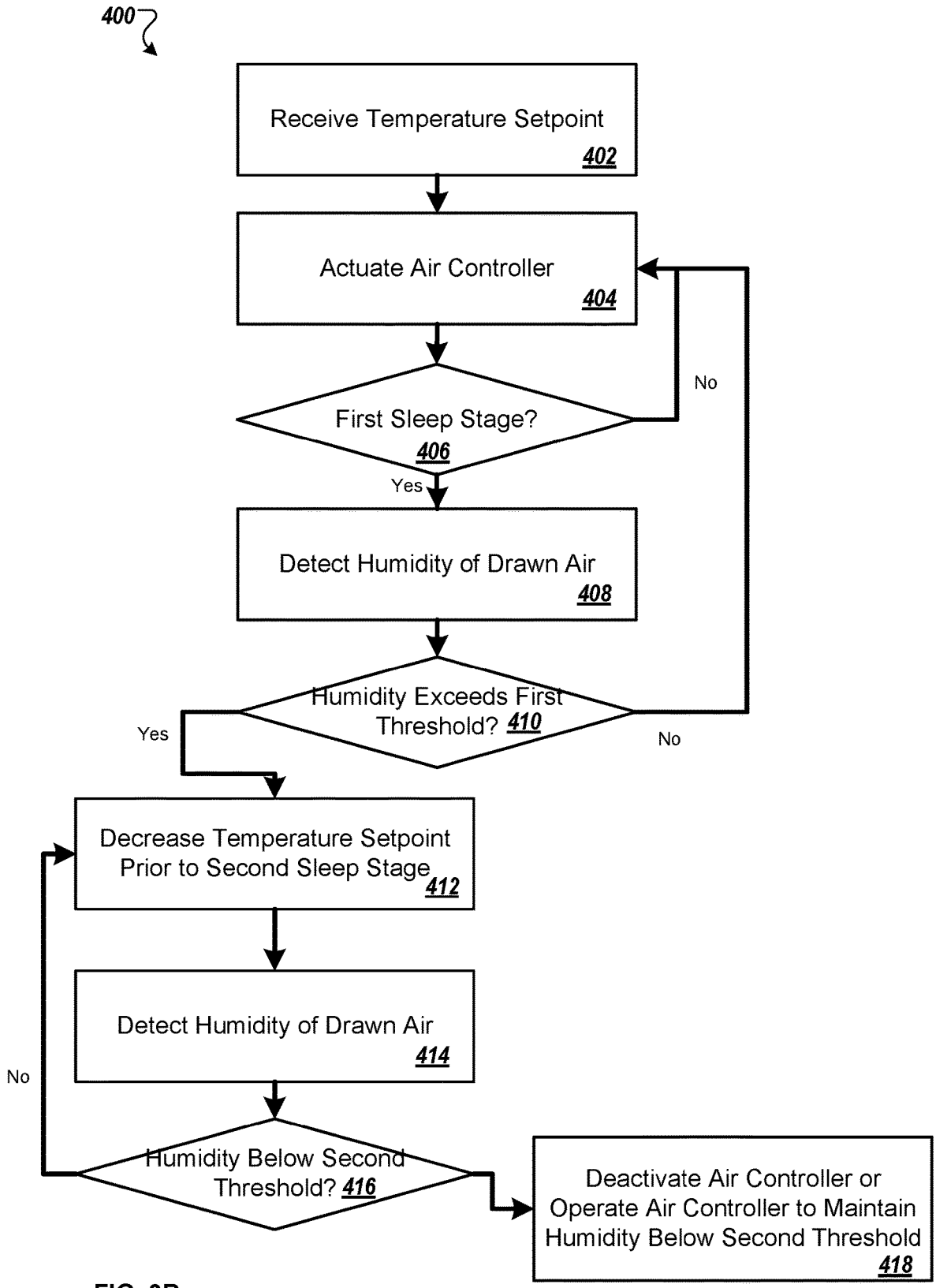
FIG. 3B is a flowchart of an example process for performing a bed microclimate control based on humidity measurements.

FIG. 3B is a flowchart of an example process 400 for controlling microclimate of a bed based on humidity of air. In some implementations, the process 400 can be implemented using the bed system 100 and/or the airflow pad insert control system 116 (also referred to herein as the air controller or the like). The airflow pad insert control system 116 can draw ambient air from, or supply ambient or conditioned air to, the airflow pads 108A, 108B (also referred to as an air layer, air distribution layer, or the like) arranged in the mattress 104 (e.g., below the top of the mattress) to control the temperature at the top surface of the mattress.

Figure 3C:
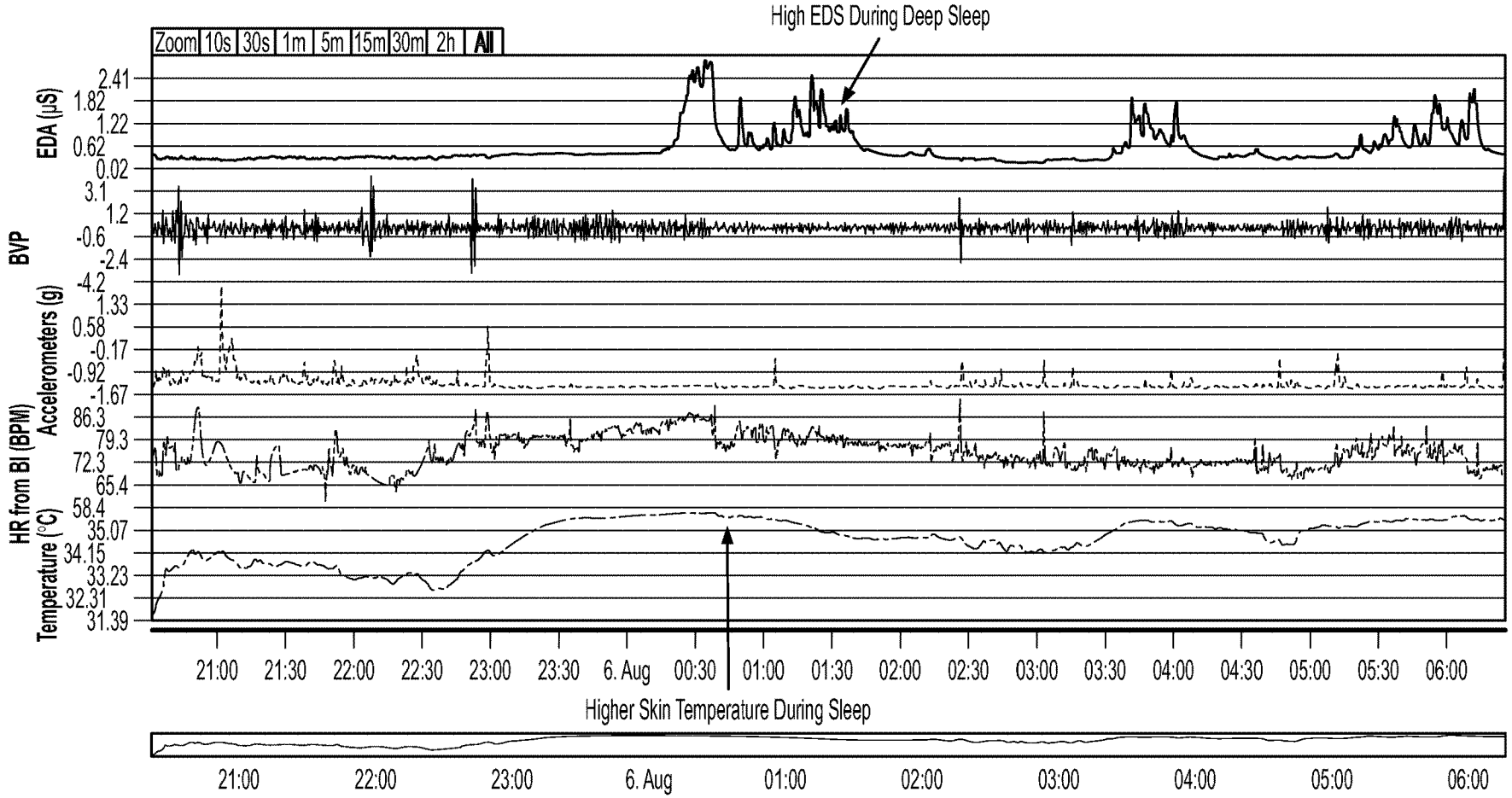
FIG. 3C illustrates example sleep characteristics during a sleep session.

From a sleep physiology perspective, a sleep session can include at least two parts. Sweat is primarily present during the first part of the sleep session. As illustrated in FIG. 3C, sweat may be prominently present in the first 3-hour time interval of the sleep session. In particular, electrodermal activity (EDA), which can represent presence of sweat, is prominent in the first hours of sleep and significantly reduced afterwards. In some cases, it may be understood that the presence of sweat in the first part of the sleep session is linked to more restorative sleep. Sweat may be reduced in the second part of the sleep session (e.g., last 3 hours) where rapid eye movement sleep occurs, as observed in the EDA graph of FIG. 3C. Therefore, it is understood that, if microclimate humidity is too high (e.g., exceeds a threshold) in the first part of sleep, the body will have harder time to sweat, thereby interfering with desired restorative sleep. In this case, the bed (e.g., an air controller or thermal module thereof) can operate to decrease the microclimate humidity to or below a preset threshold, thereby promoting higher sleep quality. In addition or alternatively, it is understood that microclimate humidity that is too low (e.g., below a threshold) in the first part of sleep (and/or other part of sleep) can be a detrimental effect on sleep quality. Therefore, the bed (e.g., an air controller or thermal module thereof) can operate to maintain the microclimate humidity, or let the microclimate humidity rise (e.g., by limiting the amount of air being removed from the bed microclimate), above another threshold (lower than the preset threshold above) so that the microclimate condition does not get too dry. In implementations where the bed system does not accommodate both requirements of temperature and humidity, the bed system can rely primarily on the temperature requirement, or rely on the temperature requirement as a sole requirement.

To achieve this, the process 400 can include receiving a temperature setpoint (Step 204). In addition or alternatively, the process 402 can include receiving other types of microclimate setpoint, such as a humidity setpoint or other parameters that may affect the microclimate of the bed. For example, such microclimate values or setpoints (or setting, setup, etc.) can be set by a user via, e.g., the bed side controller 122 or the user computing device 124. In some implementations, such values can be automatically determined to satisfy the user profile or preference. Examples of such values include temperature values, humidity, and other suitable values that can be manually or automatically determined.

The process 400 can include actuating the air controller (e.g., the airflow pad insert control system 116) to blow air into the bed, or draw air from the bed (Step 404). The airflow pad insert control system 116 can drive and/or condition the air based on the temperature setpoint, and/or other setpoints or values received at Step 402. For example, the airflow pad insert control system 116 includes the heater 164 that can be activated to heat air as the fan 160 drives the air to pass through or around the heater 164. In other implementations, the airflow pad insert control system 116 can cool air at a temperature that is manually set or automatically determined for improved or optimal microclimate control of the mattress 104. For example, the airflow pad insert control system 116 can include the cooler 166 that can be activated to cool air as the fan drives the air to pass through or around the cooler 166.

In some implementations, the airflow pad insert control system 116 can drive air so that the air is supplied to the airflow insert pads 108A and 108B of the mattress 104. In some embodiments where the air is conditioned, the airflow pad insert control system 116 operates to supply the conditioned air to the airflow insert pads 108A and 108B. In other embodiments, the airflow pad insert control system 116 can operate to supply ambient air to the airflow insert pads 108A and 108B. For example, the airflow pad insert control system 116 activates the fan 160 at a desired speed to drive the ambient or conditioned air to the airflow insert pads 108A and 108B. In alternative embodiments, the airflow pad control system 116 can draw air from the airflow insert pads 108A and 108B of the mattress 104 to thereby control a microclimate at the bed (e.g., decrease a temperature at the mattress top).

The process 400 can include determining the sleep is in a first sleep state where sweat may be substantially present (Step 406). The first sleep state can be a predetermined part of the sleep session from the beginning of the sleep. For example, the first sleep state can be the first preset hour interval (e.g., 3 hours) from the beginning of the sleep. In other examples, other initial intervals of sleep can be used for the first sleep state. If it is not the first sleep state, the process 400 returns to, for example, Step 404. If it is determined to be the first sleep state, the process 400 moves on to Step 408.

The process 400 can include detecting microclimate humidity (Step 408). In some implementations, one or more humidity sensors are used to measure humidity of the air at one or more locations. The process 400 can include determining whether the measured humidity deviates from a first threshold value or range (Step 410). In some implementations, the airflow pad insert control system 116 evaluates if the humidity value deviates from a specified threshold range (Step 410). For example, the first threshold value can be 50%. In other examples, the first threshold value can be value between 40% and 60%. In yet other examples, the first threshold value can be a value between 30% and 70%. If the humidity value does not exceed the first threshold value or range, the process 400 returns to, for example, Step 404. It the humidity value exceeds the first threshold value or range, the process 400 moves on to Step 412.

The process 400 can include decreasing the temperature setpoint prior to a second sleep state (Step 412). The second sleep state is a part of the sleep session where sweat is not predominant. The second sleep state can be a part of the sleep session subsequent to the first sleep state, and the user's body generates less sweat in the second sleep state than in the first sleep state. For example, the second sleep state can be last 3 hours of the sleep session. In Step 412, the temperature setpoint and/or other setpoints for operating the airflow pad insert control system 116 can be adjusted to control the microclimate of the mattress 104, thereby reducing the microclimate humidity.

The process 400 can include detecting microclimate humidity again (Step 414). The humidity can be measured in the same or similar way as described with respect to Sept 408 above. The process 400 can include determining whether the measured humidity deviates from a second threshold value or range (Step 416). For example, the second threshold value can be 30%. In other examples, the second threshold value can be value between 20% and 40%. In yet other examples, the second threshold value can be a value between 10% and 50%. If the humidity value is below the second threshold value or range, the process 400 moves on to Step 418. The process 400 can include deactivating the air controller or operate the air controller to maintain the microclimate humidity to be below the second threshold value or range prior to the second sleep state (Step 418). If the humidity value is not below the second threshold value or range, the process 400 returns to for example, Step 412.

Figure 4A:
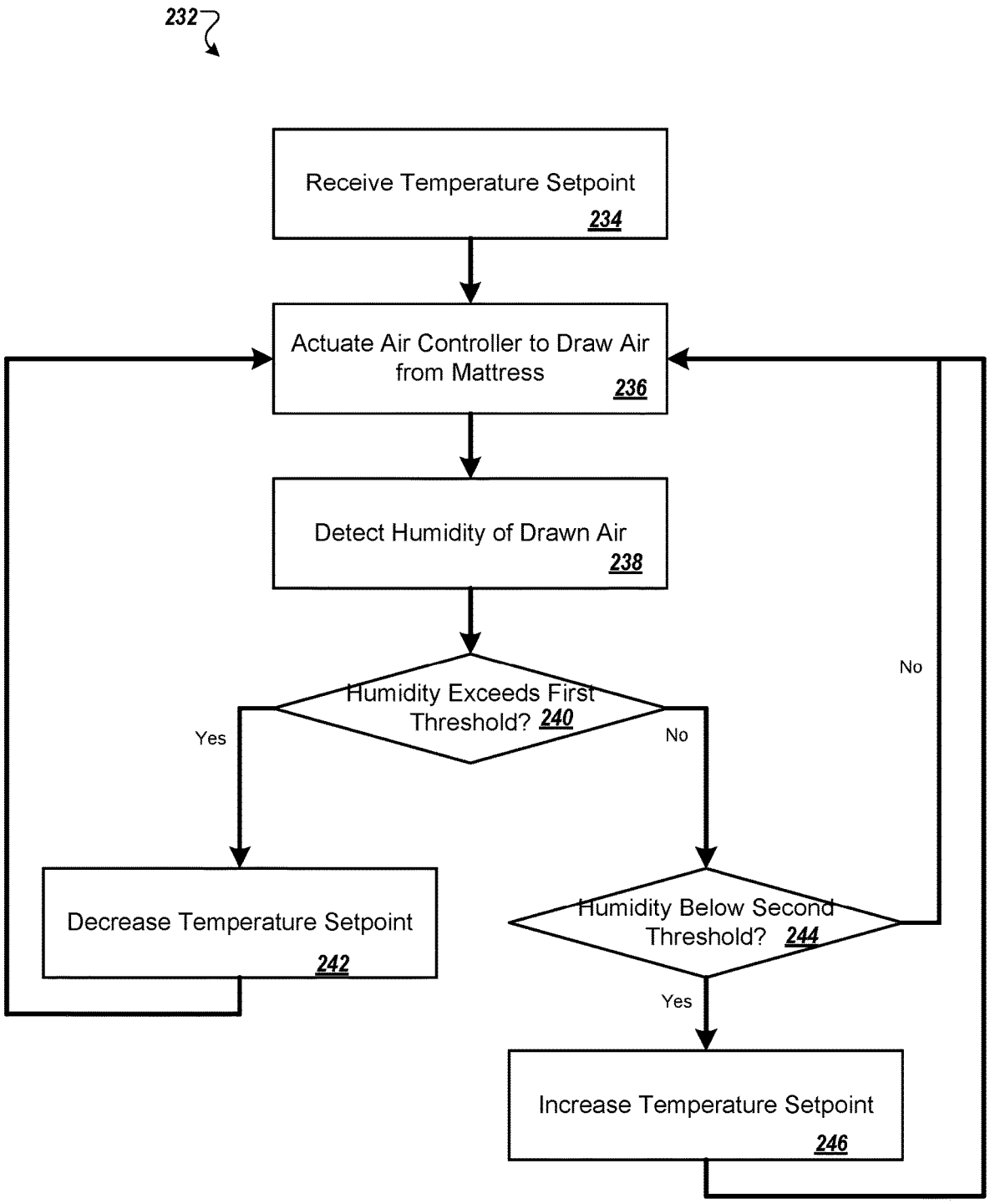
FIGS. 4A-4B are flowcharts of example processes for performing a bed microclimate control based on humidity measurements in different modes of operation.

FIG. 4A is a flowchart of an example process 232 for controlling microclimate of a bed 102 based on humidity of air. In some implementations, the process 232 can be implemented using the bed system 100 and/or the airflow pad insert control system 116. For example, the airflow pad insert control system 116 operates to control microclimate of the bed 102 by drawing air from the airflow insert pads 108A and 108B.

In some implementation the process 232 includes receiving a temperature setpoint (Step 234). In addition or alternatively, the process 232 can include receiving other types of microclimate setpoint, such as humidity setpoint or other parameters that may affect the microclimate of the mattress.

The process 232 can include actuating the air controller (e.g., the airflow pad insert control system 116) to draw air from the mattress (Step 236). For example, the airflow pad insert control system 116 can operate to draw air from the airflow insert pads 108A and 108B and thus control microclimate of the bed 102.

The process 232 can include detecting humidity of the drawn air (Step 238). For example, the airflow pad insert control system 116 can detect a humidity of the drawn air. As described in FIG. 2B, the system 116 (e.g., the air controller 300) can use a humidity sensor (e.g., the connection-side humidity sensor 326) to detect the humidity of air being drawing into the system 116 (e.g., the housing 302 of the air controller 300). The humidity of the drawn air can represent or be correlated with microclimate humidity at or adjacent the top of the mattress that is occupied by a user.

In addition or alternatively, the process 232 can include detecting one or more other characteristics of the air drawn from the mattress. For example, as described in FIG. 2B, the system 116 (e.g., the air controller 300) can use a temperature sensor (e.g., the connection-side temperature sensor 322) to detect a temperature of air being drawn into the system 116 (e.g., the housing 302 of the air controller 300). The temperature of the drawn air can represent or be correlated with a microclimate temperature at or adjacent the top of the mattress that is occupied by the user.

In some implementations, the airflow pad insert control system 116 includes one or more humidity sensors (e.g., the humidity sensor 180) for detecting the humidity of the drawn air. In addition, the airflow pad insert control system 116 can detect a temperature of the supplied air using, for example, the temperature sensor 178. Other characteristics of the drawn air can also be detected for various purposes.

Examples of the humidity sensors and the temperature sensors are described here, for example with reference to FIG. 2B.

The process 232 can include determining whether the detected humidity exceeds a first threshold value or range (Step 240). For example, the airflow pad insert control system 116 can compare the value of the detected humidity (and/or other characteristics) of the drawn air with a predetermined value (e.g., the first threshold value or range) and identify a difference between the values. The predetermined value (the first threshold value or range) can represent a value for achieving desired microclimate control (e.g., desired temperature, humidity, etc.) at the bed. For example, the predetermined value can include a predetermined air humidity value or humidity threshold value (e.g., at the location of the temperature sensor) required to achieve a desired temperature and/or humidity at the particular area in the bed (e.g., at the top of the mattress).

The process 232 can include, if the detected humidity (and/or other detected value) exceed the predetermined humidity threshold value (e.g., if the identified difference between the detected humidity and the first threshold value is greater than zero or a predetermined value), decreasing the temperature setpoint and/or other setpoints received at Step 234 (Step 242). Then, the process 232 can return to Step 236 in which the air controller (e.g., the airflow pad insert control system 116) continue to operate to draw air from the mattress.

Alternatively, if the detected humidity (and/or other detected values) do not exceed the predetermined humidity threshold value (e.g., if the identified difference between the detected humidity and the first threshold value is zero or less than the predetermined value), the process 232 can include determining whether the detected humidity is less than a second threshold value (Step 244). If the detected humidity is less than the second threshold value, the process 232 can include increasing the temperature setpoint and/or other setpoints received at Step 234 (Step 246). Then, the process 232 can return to Step 236 in which the air controller (e.g., the airflow pad insert control system 116) continue to operate to draw air from the mattress.

If the detected humidity is not less than the second threshold value (i.e., greater than the first threshold value but less than the second threshold value), the process 232 return to Step 236 in which the air controller (e.g., the airflow pad insert control system 116) continue to operate to draw air from the mattress.

Such increased or decreased temperature setpoints can modify the operation of the air controller (e.g., the airflow pad insert control system 116). For example, the decreased temperature setpoint can cause the air controller to draw air at a relatively high airflow rate (e.g., by speeding up a fan) so that the accumulated humid air at the top of the mattress can be removed at a higher rate. For example, where the air controller has been drawing air at a first airflow rate, the air controller can increase the airflow rate higher than the first airflow rate when the temperature setpoint is decreased based on the humidity measurements (i.e., increased humidity). On the other hand, the increased temperature setpoint can cause the air controller to draw air at a relatively slow airflow rate (e.g., by slowing down the fan) to thereby allow the temperature and humidity at the top of the mattress to potentially increase. For example, where the air controller has been drawing air at a first airflow rate, the air controller can decrease the airflow rate lower than the first airflow rate when the temperature setpoint is increased based on the humidity measurements (i.e., decreased humidity).

In some implementations, the detected humidity used above can be the humidity value detected by a humidity sensor in the system 116 (e.g., the connection-side humidity sensor 326 in FIG. 2B). In some implementations, the detected humidity can be an absolute humidity. Alternatively or in addition, the detected humidity can be a relative humidity.

In other implementations, the detected humidity used above can be a difference between the humidity value detected by the humidity sensor in the system 116 and an ambient humidity. The ambient humidity can be detected in various manners. For example, the system 116 (e.g., the air controller 300 in FIG. 2B) includes the ambient-side humidity sensor 328 (FIG. 2B) that measures humidity of air drawing into the system 116 (e.g., the housing 302 of the air controller 300) and thus representing the ambient humidity. To achieve this, the system 116 can temporarily (e.g., a few seconds) reverse the airflow through the air controller (e.g., from the draw direction D1 to the blow direction D2) and measure the humidity of air being drawn into the air controller. Once the ambient air is detected by the ambient-side humidity sensor 328 (FIG. 2B), the airflow is returned to the original direction to draw air from the mattress. In other example, a humidity sensor that is positioned outside the system 116 can be used to measure ambient humidity.

Figure 4B:
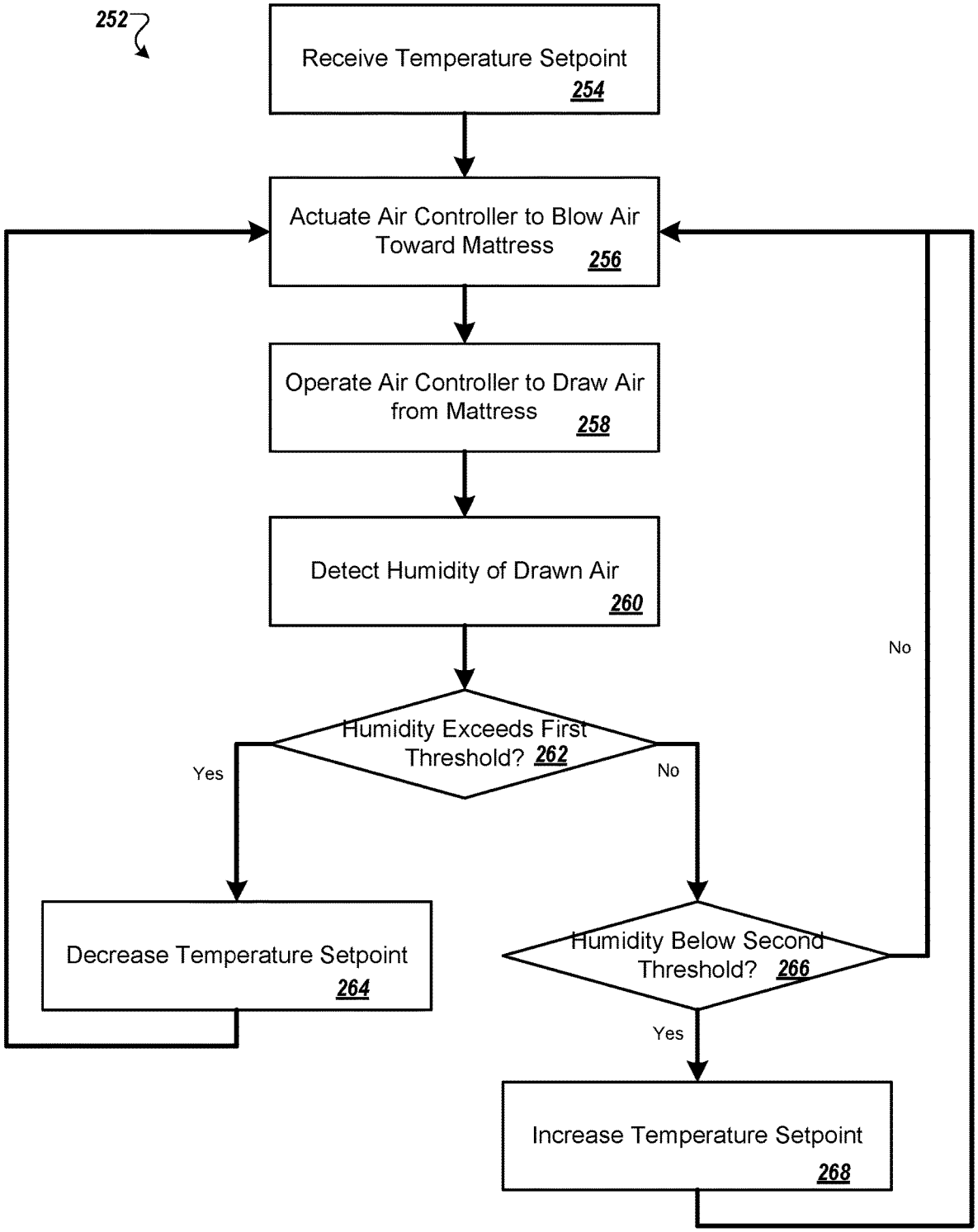

FIG. 4B is a flowchart of an example process 252 for controlling microclimate of a bed 102 based on humidity of air. In some implementations, the process 252 can be implemented using the bed system 100 and/or the airflow pad insert control system 116. In this process, the airflow pad insert control system 116 can operate to control microclimate of the bed 102 by supplying air into the airflow insert pads 108A and 108B.

In some implementations, the airflow pad insert control system 116 can receive a temperature setpoint (Step 254). In addition or alternatively, the airflow pad insert control system 116 can receive other types of microclimate setpoint, such as humidity setpoint or other parameters that may affect the microclimate of the mattress.

The process 252 can include actuating the air controller (e.g., the airflow pad insert control system 116) to blow air into the mattress (Step 256). The air supplied from the air controller can flow toward the mattress top. In some implementations, the air controller can condition air before supplying it to the mattress.

The process 252 can include operating the air controller to draw air from the mattress (Step 258), so that one or more characteristics of the drawn air can be measured as described below. For example, the air controller can operate to draw air from the mattress for a relatively short period of time during the blowing mode (Step 258) in which the air controller continues to blow air to the mattress for controlling microclimate at the top of the mattress. The duration of drawing air from the mattress can be determined to ensure that the characteristics (e.g., humidity, temperature, etc.) of the drawn air can be reliably measured. In some implementations, the air controller can draw air from the mattress for 5 seconds to 10 minutes. In other implementations, the air controller can draw air for less than 5 seconds or longer than 10 minutes.

The process 252 can include detecting humidity of the drawn air (Step 260). For example, the airflow pad insert control system 116 can detect a humidity of the drawn air. In addition or alternatively, the process 252 can include detecting one or more other characteristics of the air drawn from the mattress.

In some implementations, the airflow pad insert control system 116 includes one or more humidity sensors (e.g., the humidity sensor 180) for detecting the humidity of the drawn air. In addition, the airflow pad insert control system 116 can detect a temperature of the supplied air using, for example, the temperature sensor 178. Other characteristics of the drawn air can also be detected for various purposes.

As described in FIG. 2B, the system 116 (e.g., the air controller 300) can use a humidity sensor (e.g., the connection-side humidity sensor 326) to detect the humidity of air being drawing into the system 116 (e.g., the housing 302 of the air controller 300). The humidity of the drawn air can represent or be correlated with microclimate humidity at or adjacent the top of the mattress that is occupied by a user. Further, as described in FIG. 2B, the system 116 (e.g., the air controller 300) can use a temperature sensor (e.g., the connection-side temperature sensor 322) to detect a temperature of air being drawn into the system 116 (e.g., the housing 302 of the air controller 300). The temperature of the drawn air can represent or be correlated with a microclimate temperature at or adjacent the top of the mattress that is occupied by the user.

The process 252 can include determining whether the detected humidity exceeds a first threshold value or range (Step 262). For example, the airflow pad insert control system 116 can compare the value of the detected humidity (and/or other characteristics) of the drawn air with a predetermined value (e.g., the first threshold value or range) and identify a difference between the values. The predetermined value (the first threshold value or range) can represent a value for achieving desired microclimate control (e.g., desired temperature, humidity, etc.) at the bed. For example, the predetermined value can include a predetermined air humidity value or humidity threshold value (e.g., at the location of the temperature sensor) required to achieve a desired temperature and/or humidity at the particular area in the bed (e.g., at the top of the mattress).

The process 252 can include, if the detected humidity (and/or other detected value) exceed the predetermined humidity threshold value (e.g., if the identified difference between the detected humidity and the first threshold value is greater than zero or a predetermined value), decreasing the temperature setpoint and/or other setpoints received at Step 254 (Step 264). Then, the process 252 can return to Step 256 in which the air controller (e.g., the airflow pad insert control system 116) continue to operate to supply air from the mattress.

Alternatively, if the detected humidity (and/or other detected values) do not exceed the predetermined humidity threshold value (e.g., if the identified difference between the detected humidity and the first threshold value is zero or less than the predetermined value), the process 252 can include determining whether the detected humidity is less than a second threshold value (Step 266). If the detected humidity is less than the second threshold value, the process 252 can include increasing the temperature setpoint and/or other setpoints received at Step 254 (Step 268). Then, the process 252 can return to Step 256 in which the air controller (e.g., the airflow pad insert control system 116) continue to operate to supply air from the mattress.

If the detected humidity is not less than the second threshold value (i.e., greater than the first threshold value but less than the second threshold value), the process 252 return to Step 256 in which the air controller (e.g., the airflow pad insert control system 116) continue to operate to supply air from the mattress.

Such increased or decreased temperature setpoints can modify the operation of the air controller (e.g., the airflow pad insert control system 116). For example, the decreased temperature setpoint can cause the air controller to blow air at a relatively high airflow rate (e.g., by speeding up a fan) so that the accumulated humid air at the top of the mattress can be pushed out at a higher rate. For example, where the air controller has been supplying air at a first airflow rate, the air controller can increase the airflow rate higher than the first airflow rate when the temperature setpoint is decreased based on the humidity measurements (i.e., increased humidity). In addition or alternatively, the decreased temperature setpoint can cause the air controller to cool air before it is supplied to the mattress, so that the cooled air (together with the increased airflow rate) can reduce the temperature and/or humidity of the air at the top of the mattress faster.

On the other hand, the increased temperature setpoint can cause the air controller to supply air at a relatively slow airflow rate (e.g., by slowing down the fan) to thereby allow the temperature and humidity at the top of the mattress to potentially increase. For example, where the air controller has been drawing air at a first airflow rate, the air controller can decrease the airflow rate lower than the first airflow rate when the temperature setpoint is increased based on the humidity measurements (i.e., decreased humidity). In addition or alternatively, the increased temperature setpoint can cause the air controller to heat air before it is supplied to the mattress, so that the heated air (together with the decreased airflow rate) can let the temperature and/or humidity of the air rise at the top of the mattress.

In some implementations, the adjusted temperature setting (and other adjusted microclimate settings) can allow the air controller (e.g., airflow pad insert control system 116) to operate to adjust conditioning of air and/or supplying of ambient or conditioned air. For example, the airflow pad controller 156 can control the air conditioner 162 to adjust the temperature of air, and/or control the fan 160 to change the flow rate of the air. The temperature and/or the flow rate of air can be adjusted to reduce or eliminate the difference between the value of the detected characteristic (e.g., humidity) of air and the predetermined value(s) (e.g., the threshold (s)), so that the desired temperature and/or humidity can be achieved at the particular bed area (e.g., at the top of the mattress). Alternatively, the temperature and/or the flow rate of air can be adjusted so that the value of the detected characteristic (e.g., humidity) of the drawn air falls within a threshold range representative of desired microclimate control.

In some implementations, the detected humidity used above can be the humidity value detected by a humidity sensor in the system 116 (e.g., the connection-side humidity sensor 326 in FIG. 2B). In some implementations, the detected humidity can be an absolute humidity. Alternatively or in addition, the detected humidity can be a relative humidity.

In other implementations, the detected humidity used above can be a difference between the humidity value detected by the humidity sensor in the system 116 and an ambient humidity. The ambient humidity can be detected in various manners. For example, the system 116 (e.g., the air controller 300 in FIG. 2B) includes the ambient-side humidity sensor 328 (FIG. 2B) that measures humidity of air drawing into the system 116 (e.g., the housing 302 of the air controller 300) and thus representing the ambient humidity. To achieve this, the system 116 can simply use the ambient-side humidity sensor 328 to measure humidity of air that is drawn into the system 116 (e.g., the housing 302 of the air controller 300) and flows toward the mattress (e.g., in the blow direction D2 in FIG. 2B) and measure the humidity of air being drawn into the air controller. In other example, a humidity sensor that is positioned outside the system 116 can be used to measure ambient humidity.

Figure 5:
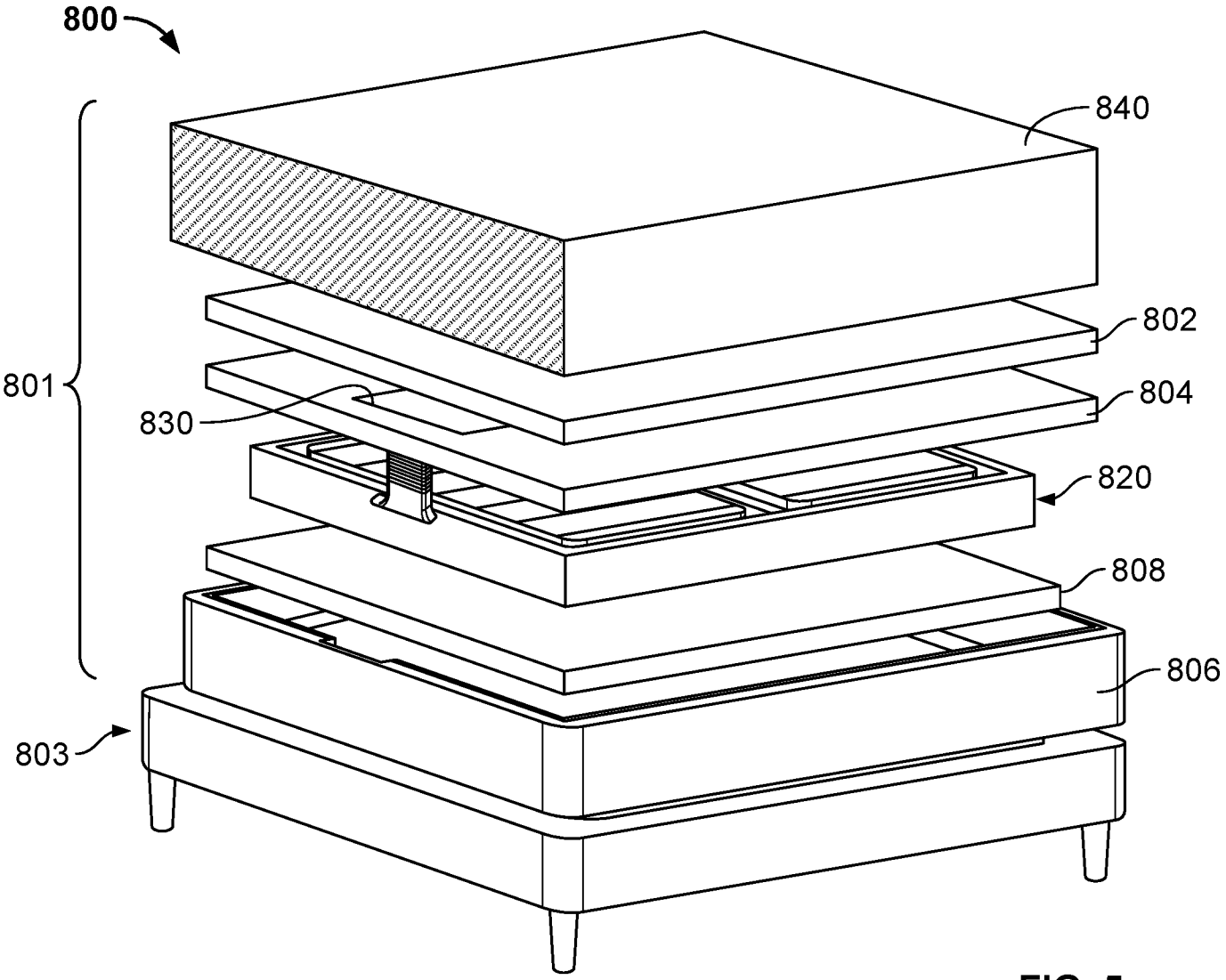
FIG. 5 illustrates an example bed system.

FIG. 5 illustrates an example bed system 800. The bed system 800 can be the bed system 102 as depicted and described throughout this disclosure (e.g., refer to FIGS. 1-4). In this example, the bed system 800 includes a mattress 801 and a foundation 803, which can be configured to be identical or similar to the mattresses and the foundations described herein. In general, the mattress 801 can be configured as a climate-controlled mattress, and include a mattress core, an air distribution layer, an air hose, an air controller, and a mattress cover. The mattress core is configured to support a user resting on the mattress. The air distribution layer is configured to facilitate air flow for climate control of a top surface of the mattress. The air hose is configured to route ambient or conditioned air into and from the air distribution layer. The air controller is fluidly connected to the air distribution layer via the air hose, and operates to cause ambient or conditioned air to flow into or from the air distribution layer. The mattress cover is used to enclose the mattress core, the air distribution layer, the sensor strip 112, and at least part of the air hose.

Still referring to FIG. 5, the mattress 801 can include a top layer 802, an intermediate layer 804, a rail structure 806, a bottom layer 808, an air chamber assembly 820, and an airflow layer 830. Any one or more of the layers 802, 804, 806, 808, and/or 830 can be made of foam, fabric, or another compressible material. Further, the mattress 801 includes a mattress cover 840 having a top surface, a bottom surface, and side surfaces, which are configured to at least partially cover the top layer 802, the intermediate layer 804, the rail structure 806, the bottom layer 808, the air chamber assembly 820, and the airflow layer 830.

Figure 6A:
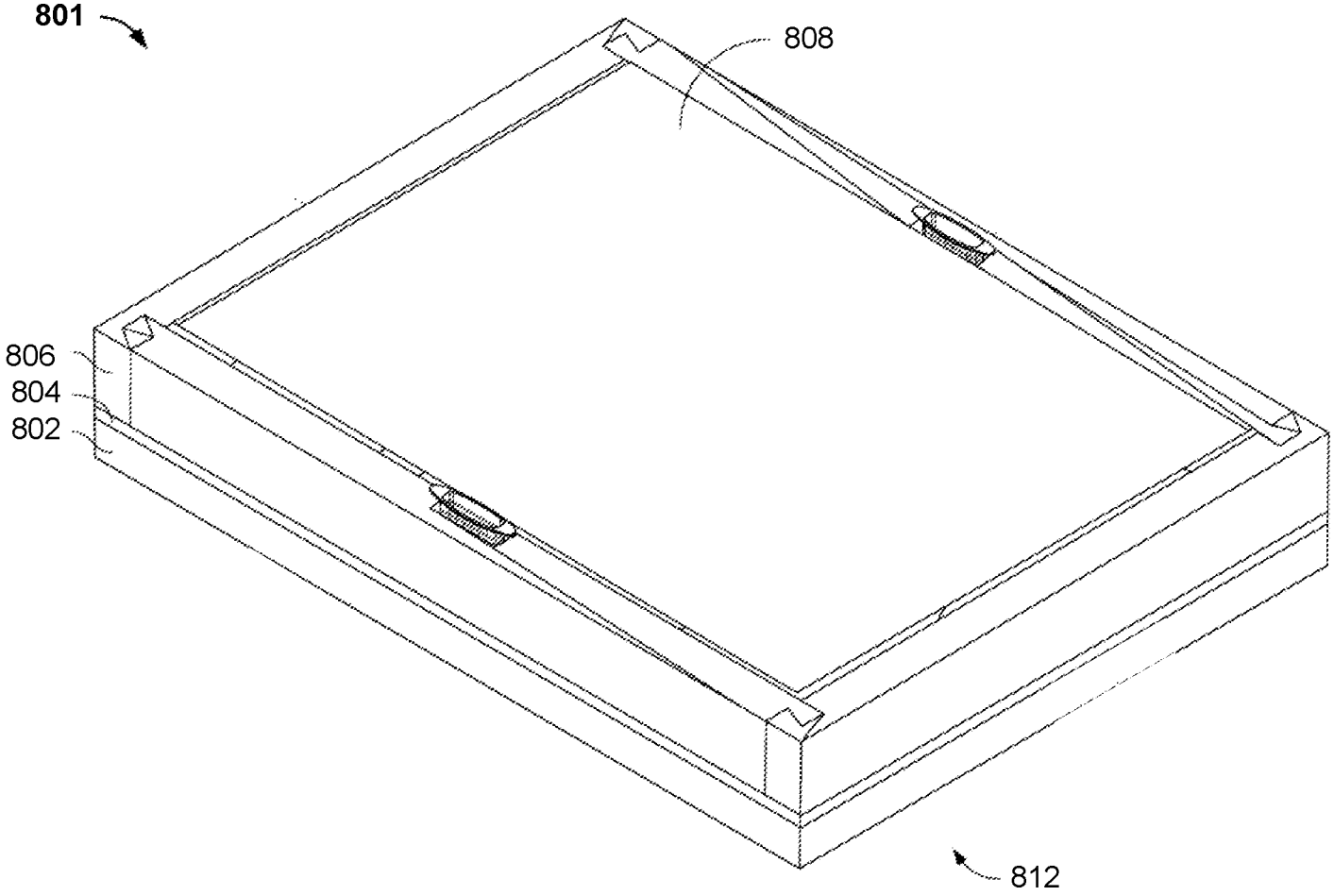
FIG. 6A is a bottom perspective view of a mattress in FIG. 1.
Figure 6B:
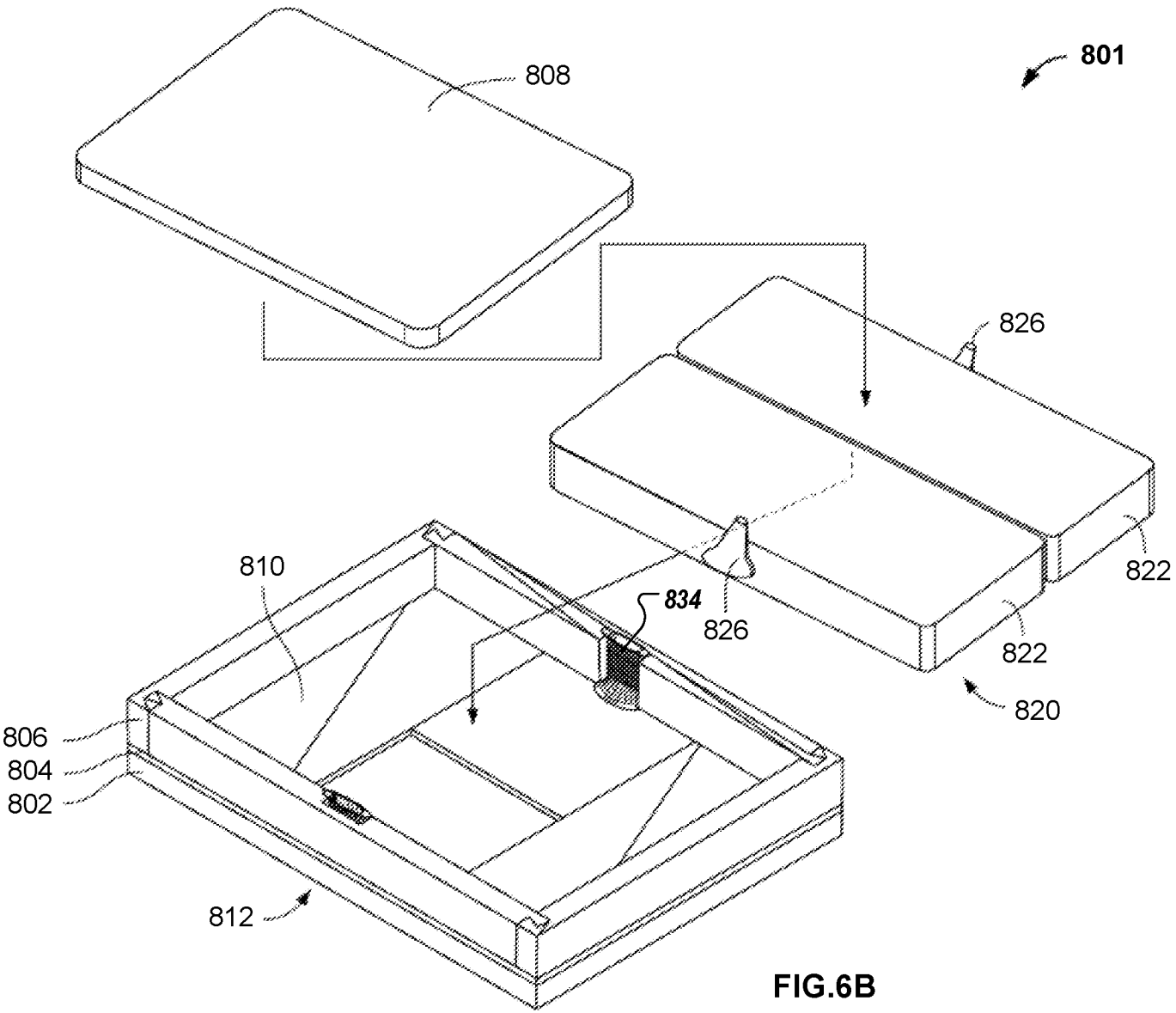
FIG. 6B is a partial exploded view of parts of the mattress shown in FIG. 6A.

FIG. 6A is a bottom perspective view of the mattress system 801, illustrating the mattress system 801 upside down. The mattress system 801 can include the top layer 802, the intermediate layer 804, the rail structure 806, and the bottom layer 808. In some implementations, the top layer 802, the intermediate layer 804 and the bottom layer 808 are arranged in order from the top to the bottom of the mattress system 801. The rail structure 806 is arranged around a periphery of the mattress system 801 and configured to at least partially surround an air chamber assembly 820 (FIG. 6B). As illustrated in FIG. 6A, the bottom layer 808 can be disposed to be at least partially surrounded by the rail structure 806. The bottom layer 808 can be configured to close a space 810 (FIG. 6B) defined by the rail structure 806. In other implementations, the bottom layer 808 can be configured and disposed above the rail structure 806.

FIG. 6B is a partial exploded view of the mattress system 801 of FIG. 6A (disposed upside down). The mattress system 801 can include the air chamber assembly 820. In the illustrated example, the air chamber assembly 820 includes a pair of air chambers 822 disposed between the top layer 802 and the bottom layer 808. The air chambers 822 can be arranged to be surrounded by the rail structure 806. The air chamber assembly 820 can further include a pump system configured to inflate and/or deflate the air chambers 822.

Figure 6C:
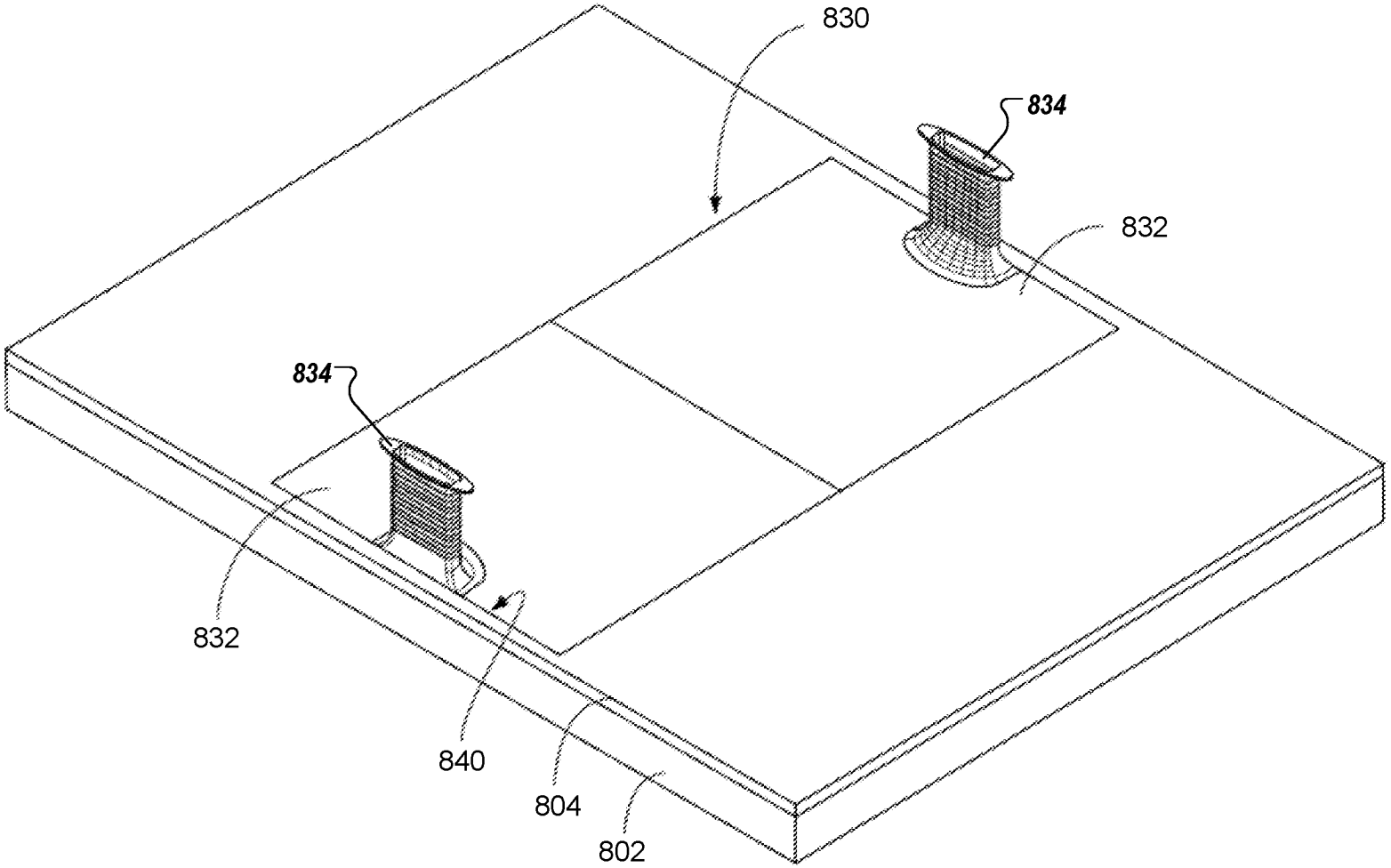
FIG. 6C is a partial exploded view of part of the mattress shown in FIG. 6A.

The mattress system 801 further includes an airflow layer 830 configured to distribute ambient or conditioned air therethrough and into the top layer 802, and/or draw ambient or conditioned air therethrough and from the top layer 802. The airflow layer 830 can include one or more airflow pad assemblies 832 (FIG. 6C). The airflow layer can also be referred to herein as the airflow distribution layer, air distribution layer, or other similar terms. The airflow pad assembly can also be referred to herein as the airflow pad, the airflow insert, or other similar terms.

As depicted in FIG. 6B, the rail structure 806 can be disposed on the intermediate layer 804 to define the space 810 for at least partially receiving the air chamber assembly 820. The bottom layer 808 can be disposed at least partially within the space 810 to at least partially cover the space 810 and the air chamber assembly 820 within the space 810.

The top layer 802, the intermediate layer 804, the rail structure 806, and the bottom layer 808 can be made of various materials. For example, at least one of the top layer 802, the intermediate layer 804, the rail structure 806, and the bottom layer 808 can be made of foam, which may be closed-cell, open-cell, or a combination thereof. Other materials, such as one or more coil springs, air chambers, spacer materials, and/or other suitable materials, can be used for at least one of the top layer 802, the intermediate layer 804, the rail structure 806, and the bottom layer 808.

FIG. 6C is a partial exploded view of the mattress system 801 of FIG. 6A (disposed upside down), illustrating the top layer 802, the intermediate layer 804, and the airflow layer 830. The airflow pad assemblies 832 can be disposed in a cutout section of the intermediate layer 804. The airflow pad assemblies 832 can be enclosed in the cutout section and surrounded by the intermediate layer 804 such that the airflow pad assemblies 832 are not exposed on the lateral sides of the mattress system 800. In other words, the airflow pad assemblies 832 are not visible from any lateral side of the mattress system 801, and the intermediate layer 804 is instead visible from the lateral sides of the mattress system 801. The airflow pad assemblies 832 can be attached to a bottom surface of the top layer 802 through the cutout section of the intermediate layer 804. The airflow pad assemblies 832 can be attached to the bottom surface of the top layer 802 in various ways. For example, the airflow pad assemblies 832 can be glued to the bottom surface of the top layer 802, or attached to the bottom surface of the top layer 802 using fasteners, such as hook-and-loop fasteners (e.g., VELCRO®), zippers, clips, pins, buttons, straps, ties, snap fasteners, and other suitable types of fasteners.

As described herein, the top layer 802 and the intermediate layer 804 (e.g., the airflow pad assemblies 832) can permit airflow therethrough. The intermediate layer 804 resists airflow less than the top layer 802. For example, the intermediate layer 804 can allow a higher airflow rate than the top layer 802. The intermediate layer 804 (e.g., the airflow pad assemblies 832) can operate to pull away and remove the heat that normally builds up within comfort layers (e.g., the topper layer 802), thereby effectively conditioning the microclimate of the mattress system. Further, the mattress system 801 with the intermediate layer 804 can operate to pull room ambient air into and take place of warmer air at the top of the mattress, and thus create calming refresh within the microclimate and comfort materials in the mattress. In addition, the mattress system 801 with the intermediate layer 804 can provide humidity control, which is another factor of comfort sleep. The intermediate layer 804 is configured and disposed in the mattress so that comfort and durability of the mattress are not affected by the intermediate layer 804.

Referring to FIG. 6B, the mattress system 801 further includes air chamber hoses 826 connected to the inflatable air chambers 822 for inflating or deflating the inflatable air chambers 822. For example, one end of the air chamber hose 826 is connected to the air chamber 822 to be in fluid communication with the interior of the air chamber 822, and the other end of the air chamber hose 826 is fluidly connected to a pump system. Referring to FIG. 6C, the mattress system 801 further includes air distribution hoses 834 fluidly connected to the air distribution layer (e.g., the airflow pad assemblies 832) for moving air into, from, and through the air distribution layer. In some implementations, in a direction from the bottom to the top, the air distribution hose 834 extends from a location below the inflatable air chamber, and is routed around a side of the inflatable air chamber 822 and to the air distribution layer above the inflatable air chamber 822. In other words, in the reverse direction (from the top to the bottom), the air distribution hose 834 is connected to the air distribution layer above the inflatable air chamber 822, and routed around the side of the inflatable air chamber 822 and extends to a location below the lowest level of the inflatable air chamber 822 so that the air distribution layer extends over the lowest level of the inflatable air chamber 822.

The bed system 100 can further include a fan assembly (e.g., the air controller or the airflow pad insert control system 116 described herein) configured to push or pull air into/from the air distribution layer (e.g., the airflow pad assemblies 832). The fan assembly can be mounted below the mattress foundation, while the air duct system is fluidly connected to the fan assembly and routed through the foundation and partially the mattress up to an inlet of the airflow layer. In some implementations, the air duct system can be routed through a carved-out section of the rail foam that surrounds the bed, thereby avoiding interference with the air chamber and its parts (e.g., air hoses, wiring, etc.). Alternatively, the fan assembly and the air duct system can be configured to be mounted and/or routed outside the foundation. This configuration may be advantageous where the fan assembly and the air duct system are to be provided separately from the bed system and assembled with the bed system afterwards.

Figure 7:
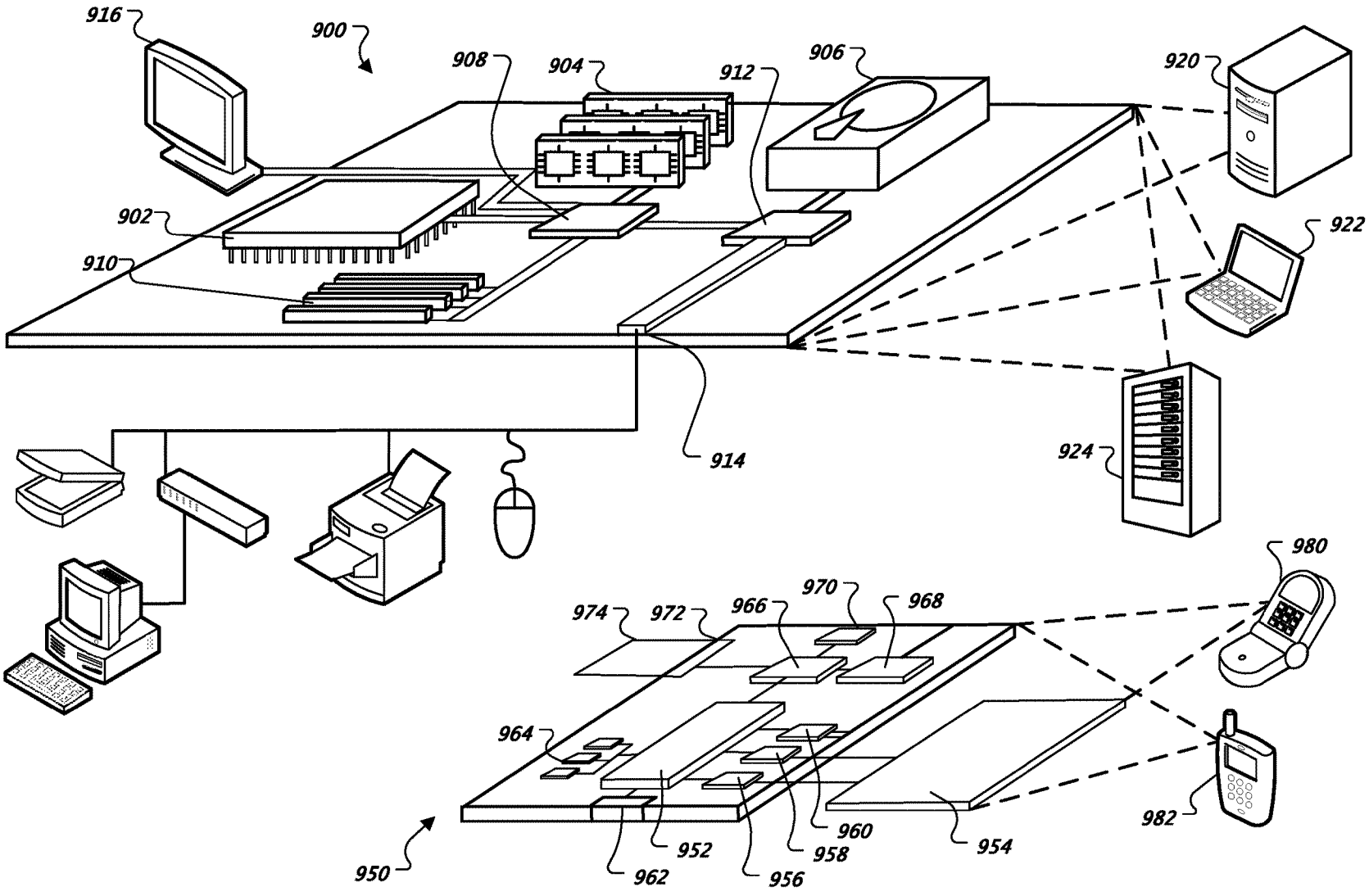
FIG. 7 is a block diagram of computing devices that may be used to implement the systems and methods described in this document, as either a client or as a server or plurality of servers.

FIG. 7 is a block diagram of computing devices 900, 950 that may be used to implement the systems and methods described in this document, as either a client or as a server or plurality of servers. Computing device 900 is intended to represent various forms of digital computers, such as laptops, desktops, workstations, personal digital assistants, servers, blade servers, mainframes, and other appropriate computers. Computing device 950 is intended to represent various forms of mobile devices, such as personal digital assistants, cellular telephones, smartphones, and other similar computing devices. The components shown here, their connections and relationships, and their functions, are meant to be examples only, and are not meant to limit implementations described and/or claimed in this document.

Computing device 900 includes a processor 902, memory 904, a storage device 906, a high-speed interface 908 connecting to memory 904 and high-speed expansion ports 910, and a low speed interface 912 connecting to low speed bus 914 and storage device 906. Each of the components 902, 904, 906, 908, 910, and 912, are interconnected using various busses, and may be mounted on a common motherboard or in other manners as appropriate. The processor 902 can process instructions for execution within the computing device 900, including instructions stored in the memory 904 or on the storage device 906 to display graphical information for a GUI on an external input/output device, such as display 916 coupled to high-speed interface 908. In other implementations, multiple processors and/or multiple buses may be used, as appropriate, along with multiple memories and types of memory. Also, multiple computing devices 900 may be connected, with each device providing portions of the necessary operations (e.g., as a server bank, a group of blade servers, or a multi-processor system).

The memory 904 stores information within the computing device 900. In one implementation, the memory 904 is a volatile memory unit or units. In another implementation, the memory 904 is a non-volatile memory unit or units. The memory 904 may also be another form of computer-readable medium, such as a magnetic or optical disk.

The storage device 906 is capable of providing mass storage for the computing device 900. In one implementation, the storage device 906 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 904, the storage device 906, or memory on processor 902.

The high-speed controller 908 manages bandwidth-intensive operations for the computing device 900, while the low speed controller 912 manages lower bandwidth-intensive operations. Such allocation of functions is an example only. In one implementation, the high-speed controller 908 is coupled to memory 904, display 916 (e.g., through a graphics processor or accelerator), and to high-speed expansion ports 910, which may accept various expansion cards (not shown). In the implementation, low-speed controller 912 is coupled to storage device 906 and low-speed expansion port 914. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 900 may be implemented in a number of different forms, as shown in the figure. For example, it may be implemented as a standard server 920, or multiple times in a group of such servers. It may also be implemented as part of a rack server system 924. In addition, it may be implemented in a personal computer such as a laptop computer 922. Alternatively, components from computing device 900 may be combined with other components in a mobile device (not shown), such as device 950. Each of such devices may contain one or more of computing device 900, 950, and an entire system may be made up of multiple computing devices 900, 950 communicating with each other.

Computing device 950 includes a processor 952, memory 964, an input/output device such as a display 954, a communication interface 966, and a transceiver 968, among other components. The device 950 may also be provided with a storage device, such as a microdrive or other device, to provide additional storage. Each of the components 950, 952, 964, 954, 966, and 968, are interconnected using various buses, and several of the components may be mounted on a common motherboard or in other manners as appropriate.

The processor 952 can execute instructions within the computing device 950, including instructions stored in the memory 964. The processor may be implemented as a chip set of chips that include separate and multiple analog and digital processors. Additionally, the processor may be implemented using any of a number of architectures. For example, the processor may be a CISC (Complex Instruction Set Computers) processor, a RISC (Reduced Instruction Set Computer) processor, or a MISC (Minimal Instruction Set Computer) processor. The processor may provide, for example, for coordination of the other components of the device 950, such as control of user interfaces, applications run by device 950, and wireless communication by device 950.

Processor 952 may communicate with a user through control interface 958 and display interface 956 coupled to a display 954. The display 954 may be, for example, a TFT (Thin-Film-Transistor Liquid Crystal Display) display or an OLED (Organic Light Emitting Diode) display, or other appropriate display technology. The display interface 956 may comprise appropriate circuitry for driving the display 954 to present graphical and other information to a user. The control interface 958 may receive commands from a user and convert them for submission to the processor 952. In addition, an external interface 962 may be provide in communication with processor 952, so as to enable near area communication of device 950 with other devices. External interface 962 may provided, for example, for wired communication in some implementations, or for wireless communication in other implementations, and multiple interfaces may also be used.

The memory 964 stores information within the computing device 950. The memory 964 can be implemented as one or more of a computer-readable medium or media, a volatile memory unit or units, or a non-volatile memory unit or units. Expansion memory 974 may also be provided and connected to device 950 through expansion interface 972, which may include, for example, a SIMM (Single In Line Memory Module) card interface. Such expansion memory 974 may provide extra storage space for device 950, or may also store applications or other information for device 950. Specifically, expansion memory 974 may include instructions to carry out or supplement the processes described above, and may include secure information also. Thus, for example, expansion memory 974 may be provide as a security module for device 950, and may be programmed with instructions that permit secure use of device 950. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 964, expansion memory 974, or memory on processor 952 that may be received, for example, over transceiver 968 or external interface 962.

Device 950 may communicate wirelessly through communication interface 966, which may include digital signal processing circuitry where necessary. Communication interface 966 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 968. In addition, short-range communication may occur, such as using a Bluetooth, WiFi, or other such transceiver (not shown). In addition, GPS (Global Positioning System) receiver module 970 may provide additional navigation- and location-related wireless data to device 950, which may be used as appropriate by applications running on device 950.

Device 950 may also communicate audibly using audio codec 960, which may receive spoken information from a user and convert it to usable digital information. Audio codec 960 may likewise generate audible sound for a user, such as through a speaker, e.g., in a handset of device 950. Such sound may include sound from voice telephone calls, may include recorded sound (e.g., voice messages, music files, etc.) and may also include sound generated by applications operating on device 950.

The computing device 950 may be implemented in a number of different forms, as shown in the figure. For example, it may be implemented as a cellular telephone 980. It may also be implemented as part of a smartphone 982, personal digital assistant, or other similar mobile device.

Additionally computing device 900 or 950 can include Universal Serial Bus (USB) flash drives. The USB flash drives may store operating systems and other applications. The USB flash drives can include input/output components, such as a wireless transmitter or USB connector that may be inserted into a USB port of another computing device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), peer-to-peer networks (having ad-hoc or static members), grid computing infrastructures, and the Internet.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A bed system comprising:

a mattress; and an air controller configured to draw air from, or supply air toward, the mattress, the air controller including:

a fan assembly configured to cause air to flow;

a humidity sensor configured to detect humidity of air; and a processor configured to:

receive a temperature setting;

activate the fan assembly based on the temperature setting at a first flowrate;

receive the humidity of air flowing through the air controller;

determine whether the humidity of air exceeds a first threshold value during a first state of sleep; and based on determining that the humidity of air exceeds the first threshold value during the first state of sleep, adjust operation of the fan assembly to control the fan assembly at a second flowrate that is greater than the first flowrate, control the fan assembly at the second flowrate prior to a second state of sleep that is different than the first state of sleep, and lower the humidity of air below the first threshold value.

2. The bed system of claim 1, wherein the processor is configured to:

based on determining that the humidity of air exceeds the first threshold value during the first state of sleep, adjust the temperature setting; and control the fan assembly based on the adjusted temperature setting.

3. The bed system of claim 1, wherein the first threshold value is a predetermined relative humidity value, wherein the predetermined relative humidity value is 50%.

4. The bed system of claim 3, the processor is further configured to:

determine whether the humidity of air is below a second threshold value during the first state of sleep; and based on determining that the humidity of air is below the second threshold value during the first state of sleep, adjust the operation of the fan assembly to increase the humidity of air above the second threshold value.

5. The bed system of claim 1, wherein the first state of sleep is an initial state of sleep from a beginning of the sleep.

6. The bed system of claim 5, wherein the first state of sleep is a 3-hour interval from a beginning of the sleep.

7. The bed system of claim 1, wherein the second state of sleep is subsequent to the first state of sleep.

8. The bed system of claim 7, wherein the second state of sleep is a last 3-hour interval of the sleep.

9. The bed system of claim 1, wherein the processor is configured to:

based on determining that the humidity of air exceeds the first threshold value during the first state of sleep, adjust operation of the fan assembly to lower the humidity of air below a second threshold value.

10. The bed system of claim 9, wherein the second threshold value is a second predetermined relative humidity value.

11. The bed system of claim 10, wherein the second predetermined relative humidity value is 30%.

12. The bed system of claim 1, wherein the mattress includes:

a comfort layer having a top surface and an opposite bottom surface, the top surface configured to support a user; and an air distribution layer disposed at the bottom surface of the comfort layer and configured to supply air toward, or draw air from, a first zone of the comfort layer, the air distribution layer having a higher air permeability than the comfort layer, wherein the air controller is fluidly connected to the air distribution layer.

13. The bed system of claim 12, wherein the air controller further includes:

a temperature sensor and configured to detect a temperature of air flowing through the air controller, wherein the processor is configured to:

based on the temperature of air and the determination that the humidity of air exceeds the first threshold value during the first state of sleep, adjust the temperature setting; and control the fan assembly based on the adjusted temperature setting.

14. The bed system of claim 13, wherein the air controller comprising:

a housing, wherein the fan assembly, the humidity sensor, and the temperature sensor are positioned within the housing.

15. The bed system of claim 1, wherein the air controller comprising:

a housing, wherein the fan assembly and the humidity sensor are positioned within the housing; and an air duct that fluidly connects the air controller with an air distribution layer, wherein the air controller defines a first air vent and a second air vent, the first air vent being fluidly coupled to an end of the air duct, wherein the humidity sensor is disposed adjacent the first air vent.

16. The bed system of claim 1, wherein in response to detecting humidity exceeding the first threshold, the processor is further configured to operate the air controller to reduce humidity until detected humidity is below a second threshold that is lower than the first threshold.

17. A bed system comprising:

a mattress; and an air controller configured to draw air from, or supply air toward, the mattress, the air controller including:

a fan assembly configured to cause air to flow;

a humidity sensor configured to detect humidity of air; and a processor configured to:

receive a temperature setting;

activate the fan assembly based on the temperature setting at a first flowrate;

receive the humidity of air flowing through the air controller;

determine whether the humidity of air exceeds a first threshold value during a first state of sleep; and based on determining that the humidity of air exceeds the first threshold value during the first state of sleep, adjust operation of the fan assembly to lower the humidity of air below the first threshold value and adjust operation of the fan assembly to lower the humidity of air below a second threshold value prior to a second state of sleep.

18. The bed system of claim 17, wherein the second state of sleep is subsequent to the first state of sleep.

19. The bed system of claim 17, wherein the humidity sensor is configured to detect humidity of air at a housing of the air controller to output a housing humidity signal, and wherein the processor is further configured to determine an estimated humidity at a top of the mattress based on the housing humidity signal.

20. A mattress system comprising:

a comfort layer having a top surface and an opposite bottom surface, the top surface configured to support a user;

an air distribution layer disposed at the bottom surface of the comfort layer and configured to supply air toward, or draw air from, a first zone of the comfort layer, the air distribution layer having a higher air permeability than the comfort layer; and an air controller defining an airflow opening that is fluidly connected to the air distribution layer, the air controller including:

a fan assembly configured to cause air to move through the air distribution layer, a temperature sensor, a humidity sensor, and a processor configured to:

receive a temperature setting, activate the fan assembly based on the temperature setting to thereby move air through the air distribution layer at a first airflow rate, receive a temperature signal from the temperature sensor, the temperature signal being representative of a temperature of air that flows through the air controller, receive a humidity signal from the humidity sensor, the humidity signal being representative of a humidity of air that flows through the air controller, based on the humidity signal that is representative of the humidity of air that flows through the air controller, determine an estimated humidity at a top of the mattress system;

adjust the temperature setting based on the temperature signal and the estimated humidity at the top of the mattress system, and activate the fan assembly based on the adjusted temperature setting to thereby move air through the air distribution layer at a second airflow rate.

* * * * *